US005542397A

United States Patent [19]

Takahata et al.

[11] Patent Number: 5,542,397

[45] Date of Patent: Aug. 6, 1996

[54] LEAK TEST SYSTEM FOR VAPORIZED FUEL TREATMENT MECHANISM

[75] Inventors: Toshio Takahata, Aikou-gun; Shinsuke Nakazawa, Yokohama; Atsushi Iochi, Yokohama; Hiroshi Kuriki, Yokohama; Kenichi Gotoh, Zama, all of Japan

[73] Assignee: Nissan Motor Co., Ltd., Kanagawa, Japan

[21] Appl. No.: 434,713

[22] Filed: May 4, 1995

[30] Foreign Application Priority Data

| | | | |
|---|---|---|---|
| May 9, 1994 | [JP] | Japan | 6-095332 |
| May 9, 1994 | [JP] | Japan | 6-095334 |
| May 9, 1994 | [JP] | Japan | 6-095335 |
| May 9, 1994 | [JP] | Japan | 6-095343 |

[51] Int. Cl.[6] ..... F02M 25/08

[52] U.S. Cl. ..... 123/520

[58] Field of Search ..... 123/516, 518, 123/519, 520, 198 D

[56] References Cited

U.S. PATENT DOCUMENTS

| | | | |
|---|---|---|---|
| 5,299,545 | 4/1994 | Kuroda et al. | 123/520 |
| 5,305,724 | 4/1994 | Chikamatsu et al. | 123/520 |
| 5,333,589 | 8/1994 | Otsuka | 123/520 |
| 5,333,590 | 8/1994 | Thomson | 123/520 |
| 5,335,638 | 8/1994 | Mukai | 123/520 |
| 5,363,828 | 11/1994 | Yamashita et al. | 123/520 |
| 5,396,873 | 3/1995 | Yamanaka et al. | 123/520 |
| 5,398,662 | 3/1995 | Igarashi et al. | 123/520 |
| 5,443,051 | 8/1995 | Otsuka | 123/520 |
| 5,448,980 | 9/1995 | Kawamura et al. | 123/520 |
| 5,450,834 | 9/1995 | Yamanaka et al. | 123/520 |
| 5,460,143 | 10/1995 | Narita | 123/520 |

*Primary Examiner*—Thomas N. Moulis

*Attorney, Agent, or Firm*—Lowe, Price, LeBlanc & Becker

[57] ABSTRACT

A first passage provided with a first valve for guiding vaporized fuel from a fuel tank into a canister, and a second passage provided with a second valve connecting this canister with an intake pipe downstream or a throttle, are provided. A pressure detecting mechanism is provided between this first valve and second valve, and a third valve is provided for leading fresh air into the canister. When the engine running condition satisfies a predetermined positive pressure test condition, the second and third valves are closed and the first valve is opened. In this state, the presence or absence of a leak is determined from the pressure detected by the pressure detecting mechanism. In other words, it is determined for example that the fuel tank has no leak if the pressure rises above a predetermined value.

31 Claims, 30 Drawing Sheets

LEAK TEST SYSTEM FOR VAPORIZED FUEL TREATMENT MECHANISM

FIELD OF THE INVENTION

This invention relates to a vaporized fuel treatment mechanism that supplies vaporized fuel in a fuel tank to an engine via a canister, and more specifically, that detects whether or not fuel is leaking from such a mechanism into the atmosphere.

BACKGROUND OF THE INVENTION

In general, to prevent vaporized fuel in an automobile fuel tank from leaking into the atmosphere, a canister filled with active carbon that adsorbs vaporized fuel is connected to the fuel tank, and vaporized fuel is adsorbed by this active carbon when the vehicle is at rest. The vaporized fuel adsorbed by the canister is discharged from the active carbon by negative intake pressure when the engine is running, and the air led into the canister, and is then supplied to the air intake pipe of the engine.

The canister and the intake pipe downstream of the engine throttle are connected by a purge passage. A purge cut valve is provided in the purge passage.

Even in this mechanism, however, If a leak occurs in the flowpath from the fuel tank to the intake pipe due to changes as a result of aging, etc., or the seals in the joins of the pipes constituting the flowpath are defective, vaporized fuel is released into the atmosphere.

The Environmental Protection Agency (EPA) and the California Air Resources Board (CARB) require that checks be performed to determined whether or not the leak amount is below a tolerance value, and that measures are taken to prevent leakage into the atmosphere if it is not. These bodies also recommend apparatuses and methods for diagnosing leaks.

In one such apparatus, an air supply valve that opens and closes the air intake passage of the canister, and a sensor that detects the pressure in the flowpath leading from the fuel tank to the purge cut valve, are provided. First, the air supply valve is closed and the purge cut valve is fully opened so that the negative pressure in the air Intake pipe downstream of the throttle is led to this flowpath, then the purge cut valve is shut so that the flowpath is sealed. If there is a leaky part in the flowpath, the pressure in sealed flowpath suddenly returns to atmospheric, whereas if there is no leak, the pressure gradually rises due to vaporized fuel generated in the fuel tank. Hence, if this pressure is monitored, it is possible to diagnose the existence or absence of a leak.

However, this test applies to the whole flowpath from the fuel tank to the purge cut valve, and when a leak is detected, it is not possible to determine what specific part of the flowpath has a leak.

Moreover, as purge control must be interrupted during the leak diagnosis, it is desirable that the leak test is completed in a short time. According to the above method, however, the pressure must be compared when the pressure in the flowpath has risen to a certain level due to generation of vaporized fuel in the tank, so the test takes some time.

Further, when the engine is in the idle state, the purge cut valve is generally closed and the vaporized fuel mechanism is set so that purge is not performed in order to maintain driving performance. The above apparatus therefore does not perform a leak test in the idle state. If the engine enters the idle state during a leak test, the whole test is stopped, and the test is repeated from the beginning when the running conditions are once again suitable for test. Consequently, during running conditions when the engine often enters an idle state, a test for the presence of a leak cannot be performed.

In the case of the above test, determination of the presence or absence of a leak may be made for example by calculating the ratio of the time taken for the flowpath to reach a predetermined negative pressure due to introduction of intake negative pressure into the flowpath, to the time taken for the flowpath pressure to return to a predetermined value from when the purge cut valve is shut, and comparing the result with a preset reference value.

In this case, if the accelerator is depressed while negative pressure is being introduced into the flowpath, the intake negative pressure becomes weaker so that the time required for the flowpath to reach the predetermined negative pressure increases. There is then a risk that the extent of a leak may be estimated to be greater than it really is.

SUMMARY OF THE INVENTION

It is therefore an object of this invention to test for the presence of a leak at a specific point in a flowpath for vaporized fuel such as a fuel tank or air supply valve.

It is a further object of this invention to shorten the time required to test for the presence of a leak.

It is a still further object of this invention to make it possible to test for the presence of a leak under a wider range of engine running conditions.

It is yet a further object of this invention to improve the accuracy of testing for the presence of a leak.

In order to achieve the above objects, this invention provides a leak test system for a vaporized fuel treatment mechanism comprising a fuel tank for supplying fuel to an engine mounted in an automobile, an intake pipe for aspirating air for combustion in the engine, a throttle provided in the intake pipe for regulating an amount of the air, a canister for adsorbing vaporized fuel, a first passage for leading vaporized fuel from the fuel tank to the canister, a first valve for opening and closing the first passage, a second passage connecting the canister with the intake pipe downstream of the throttle, a second valve for opening and closing the second passage, a third valve for introducing fresh air into the canister, a mechanism for detecting pressure in a first flowpath section from the first valve to the second valve via the canister, a first determining mechanism for determining whether or not an engine running condition satisfies a predetermined positive pressure test condition, a first operating mechanism for closing the second and third valves while opening the first valve, and a second determining mechanism for determining a presence or absence of a leak based on a variation of the pressure according to an operation of the first operating mechanism.

The second determining mechanism determine, for example, the fuel tank has no leak when the pressure is equal to or greater than the predetermined value after the operation of the first operating mechanism.

The second determining mechanism may comprise a mechanism for sampling the pressure as a first pressure when the pressure is equal to or greater than a predetermined value after the operation of the first operating mechanism, a second operating mechanism for closing the first valve after the sampling, a first timer for measuring a time elapsed from an operation of the second operating mechanism, a mechanism for sampling the pressure in the first flowpath section as a second pressure when the time measured by the first timer has reached a predetermined value, and a third determining mechanism for determining whether or not there is a leak in the first flowpath section based on the first and second pressures.

The system may further comprise a third operating mechanism for opening the first and second valves and closing the third valve when the pressure in the first flowpath section after the operation of the first operating mechanism is less than the predetermined value, and a fourth determining mechanism for determining whether or not there is a leak in the second flowpath section from the second valve to the fuel tank via the canister, using negative pressure introduced by an operation of the third operating mechanism.

The system may further comprise a fifth determining mechanism for determining whether or not a test condition is suitable for testing by negative pressure, a mechanism for repeating a determining process by the second determining mechanism when the time measured by the first timer has reached a predetermined value and the fifth determining mechanism determines that the condition is not suitable for testing by negative pressure.

The fourth determining mechanism may comprise a second timer for measuring a time elapsed after the operation of the third operating mechanism, a mechanism for sampling the time measured by the second timer as a pull-down time when a pressure differential between a pressure in the second flowpath section and an initial pressure has reached a predetermined value, a fourth operating mechanism for closing the second valve in synchronism with the sampling of the pull-down time, a third timer for measuring a time elapsed from operation of the fourth operating mechanism, a mechanism for sampling the pressure differential between the pressure in the second flowpath section and the initial pressure as a third pressure when a predetermined time has elapsed after operation of the fourth operating mechanism, a mechanism for sampling the pressure differential between the pressure in the second flowpath section and the initial pressure as a fourth pressure when the difference between the pressure in the second flowpath section and the third pressure has reached a predetermined value, a mechanism for sampling the time measured by the third timer as a recovery time when the fourth pressure is sampled, a mechanism for computing a leak hole surface area in the second flowpath section based on the third pressure, the fourth pressure, the put-down time and the recovery time, and sixth determining mechanism for determining whether or not there is a leak in the second flowpath section by comparing the leak hole surface area with a predetermined value.

The first determining mechanism may comprise a mechanism for detecting a pressure in a third flowpath section between the first valve and the fuel tank, and seventh determining mechanism for determining that the positive pressure test condition holds when the pressure in the third flowpath section is equal to or greater than a predetermined value while the first valve is closed.

The system may further comprise a mechanism for starting the engine while the first valve remains closed, and the first determining mechanism may comprise a mechanism for detecting a fuel temperature in the fuel tank and an eighth determining mechanism for determining that the positive pressure test condition holds when a rise of fuel temperature after the engine is started has reached a predetermined value $\Delta T_1$. The predetermined value $\Delta T_1$ is preferably set larger the lower is the fuel temperature when the engine is started.

The system may further comprise a mechanism for starting the engine while the first valve remains closed, and the first determining mechanism may comprise a ninth determining mechanism for determining that the positive pressure test condition holds when a time elapsed after starting the engine has reached a predetermined value TMEVD. The predetermined value TMEVD is preferably set larger the lower is the fuel temperature when the engine is started.

The system may further comprise a fourth valve in parallel with the first valve. This fourth valve closes when a positive pressure in the fuel tank is less than a predetermined value and opens when the positive pressure is greater than a predetermined value.

The system may further comprise a tenth determining mechanism for determining whether or not the engine running condition satisfies a predetermined negative pressure test condition, and a fifth operating mechanism for closing the second valve when the negative pressure condition does not hold after the operation of the third operating mechanism and for opening the second valve when the negative pressure test condition has been restored. In this case, the second timer interrupts time measurement according to an operation of the fifth operating mechanism.

The system may further comprise a mechanism for retaining a pressure in the second flowpath section when the second valve is closed by the fifth operating mechanism, and an eleventh determining mechanism for determining whether or not the second flowpath pressure has become equal to the retained pressure after the second valve has been re-opened by the fifth operating mechanism. In this case, the second timer interrupts time measurement from when the second valve is closed to when the determined result of the eleventh determining mechanism becomes affirmative.

The system may further comprise a mechanism for detecting an atmospheric pressure, a mechanism for detecting an intake negative pressure in the intake pipe, a mechanism for computing a pressure ratio of the atmospheric pressure to the intake negative pressure, a twelfth determining mechanism for determining whether or not the pressure ratio is within a sonic region, and a mechanism for reducing the pull-down time when the ratio is outside the sonic region.

The reducing mechanism may comprise a mechanism for computing a correction coefficient based on the pressure ratio, and a mechanism for correcting the pull-down time by the correction coefficient. The correction coefficient becomes smaller as the pressure ratio approaches 1. The second timer preferably interrupts time measurement when the correction coefficient is equal to or less than a predetermined value.

The reducing mechanism may comprise a mechanism for computing a correction coefficient based on the pressure ratio, the correction coefficient becoming smaller as the pressure ratio approaches 1, a mechanism for computing a cumulative average of the correction coefficient, and a mechanism for correcting the pull-down time by the cumulative average.

The atmospheric pressure detecting mechanism and the intake negative pressure detecting mechanism may comprises a pressure sensor. The sensor comprises a mechanism for selectively supplying atmospheric pressure or intake negative pressure to the sensor. It is preferably that the mechanism for selectively supplying pressure does not supply atmospheric pressure to the pressure sensor when a wind caused by the automobile is strong.

The system may further comprise a thirteenth determining mechanism for determining whether or not a predetermined negative pressure test condition holds when there is a leak in the first flowpath section, a sixth operating mechanism for closing the first valve and opening the second and third valves when the negative pressure test condition holds, a seventh operating mechanism for closing the third valve after an operation of the sixth operating mechanism, and a fourteenth determining mechanism for determining whether or not there is a leak in the third valve based on a pressure change in the first flowpath section after closing the third valve.

The fourteenth determining mechanism determines, for example, there is no leak in the third valve when the pressure in the first flowpath section after closing the third valve is lower than a predetermined value $-p_4$. In this case, it is preferable that the system further comprises a mechanism for varying the predetermined value $-p_4$ according to a load off the engine.

The system may further comprise a fourth timer for measuring a time elapsed from when the third valve is closed, and the fourteenth determining mechanism determines, for example, there is no leak in the third valve if the pressure in the first flowpath section when the time measured by the fourth timer has reached a predetermined value $t_6$, is lower than a predetermined value $-p_4$. In this case, it is preferable that the system further comprises a mechanism for varying the predetermined value $t_6$ according to a load on the engine.

The system may further comprises a fifteenth determining mechanism for determining whether or not the predetermined negative pressure test condition holds when there is a leak in the first flowpath section, an eighth operating mechanism for closing the second and third valves so as to seal the first flowpath section when the negative pressure test condition holds, a ninth operating mechanism for opening the second valve in the sealed state of the first flowpath section, a mechanism for sampling a pressure $P_1$ detected by the pressure detecting mechanism after an operation of the ninth operating mechanism, a tenth operating mechanism for opening the first valve and closing the second and third valves when the negative pressure test condition holds, an eleventh operating mechanism for opening the second valve after an operation of the tenth operating mechanism a mechanism for sampling a pressure $P_2$ detected by the pressure detecting mechanism after an operation of the eleventh operating mechanism, and a sixteenth determining mechanism for determining whether or not there is a fault in the first valve based on the pressures $P_1$ and $P_2$.

The sixteenth determining mechanism determines, for example, there is no fault in the first valve when the pressure $P_1$ is lower than the pressure $P_2$.

The sixteenth determining mechanism may comprise a mechanism for calculating a variation $\Delta P_1$ in a predetermined time interval of the pressure $P_1$, a mechanism for calculating a variation $\Delta P_2$ in a predetermined time interval of the pressure $P_2$, and a seventeenth determining mechanism for determining whether or not there is a fault in the first valve based on the pressure variations $\Delta P_1$ and $\Delta P_2$. This seventeenth determining mechanism determines, for example, there is no fault in the first valve when the pressure variation $\Delta P_1$ is larger than the pressure variation $\Delta P_2$.

The system may further comprises an eighteenth determining mechanism determining whether or not the predetermined negative pressure test condition holds when there is a leak in the first flowpath section, a mechanism for closing the second valve and opening the third valve so as to open the second flowpath section to the atmosphere when the predetermined negative pressure test condition holds, a twelfth operating mechanism for closing the first and third valves when the second flowpath section has been opened to the atmosphere, a mechanism for sampling a pressure $P_1$ detected by the pressure detecting mechanism after an operation of the twelfth operating mechanism, a thirteenth operating mechanism for opening the first and second valves and closing the third valve when the second flowpath section has been opened to the atmosphere, a mechanism for sampling a pressure $P_1$ detected by the pressure detecting mechanism after an operation of the thirteenth operating mechanism, and a nineteenth determining mechanism for determining whether or not there is a fault in the first valve based on the pressures $P_1$ and $P_2$.

The system may further comprises a twentieth determining mechanism for determining whether or not the predetermined negative pressure test condition holds when there is a leak in the first flowpath section, a thirteenth operating mechanism for closing the second and third valves so as to seal the first flowpath section, a fourteenth operating mechanism for opening the second valve in the sealed state of the first flowpath section, a fifth timer for measuring a time elapsed after an operation of the fourteenth operating mechanism, a mechanism for sampling a measured time $t_7$ of the fifth timer when the pressure detected by the pressure detecting mechanism has reached a predetermined value $-p_4$, a fifteenth operating mechanism for opening the first valve and closing the second and third valves when the negative pressure test condition holds, a sixteenth operating mechanism for opening the second valve after operation of the fifteenth operating mechanism, a sixth timer for measuring a time elapsed after an operation of the sixteenth operating mechanism, a mechanism for sampling a pressure $P_3$ detected by the pressure detecting mechanism when the time measured by the sixth timer has reached the time $t_7$, and a twenty-first determining mechanism for determining that there is no fault in the first valve when $|P_3-p_4|$ is equal to or greater than a predetermined value $p_5$.

The details as well as other features and advantages of this invention are set forth in the remainder of the specification and are shown in the accompanying drawings.

DESCRIPTION OF THE PREFERRED EMBODIMENTS

Figure 1:
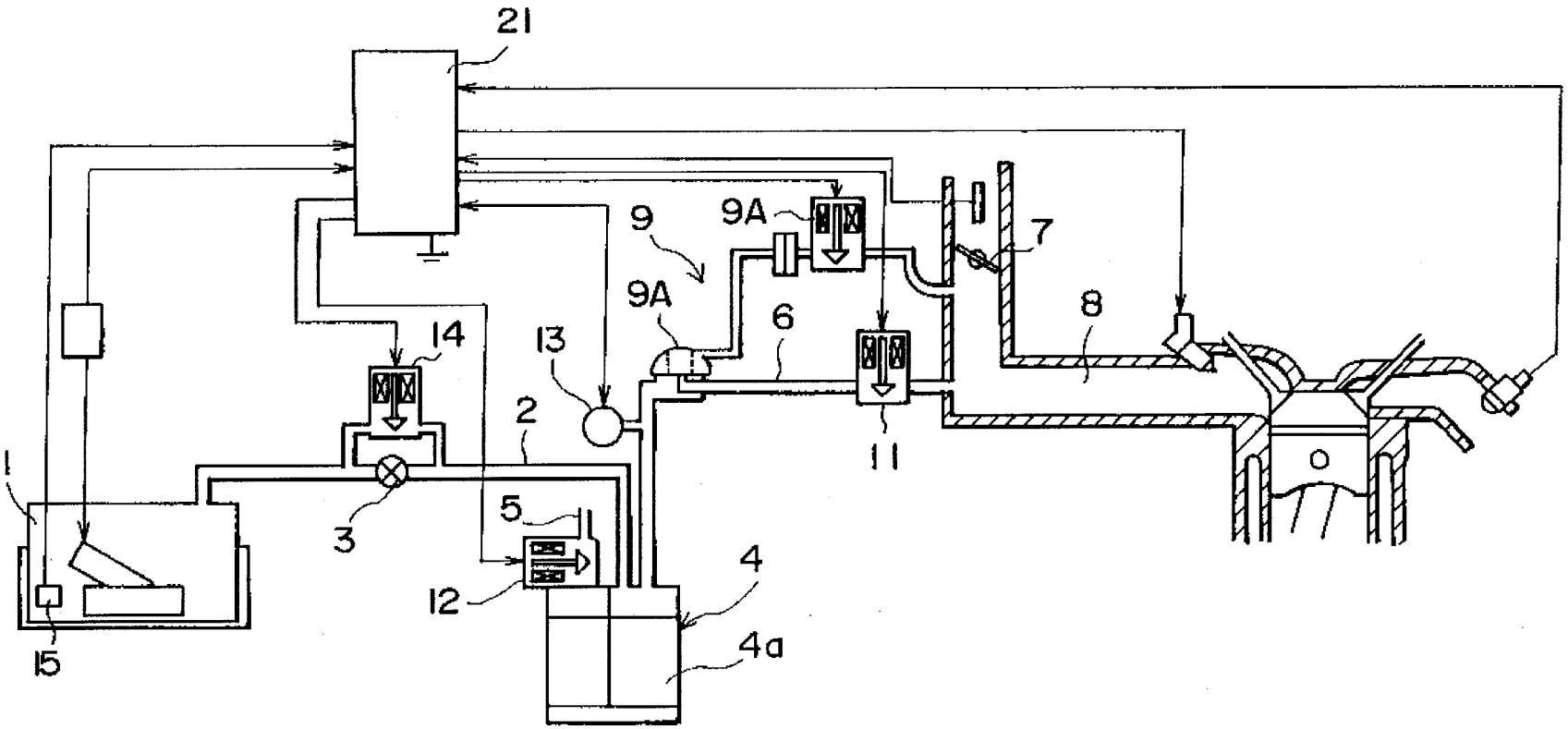
FIG. 1 is a schematic diagram of a leak test apparatus according to a first embodiment of this invention.

Referring to FIG. 1 of the drawings, vaporized fuel generated in a fuel tank 1 of a vehicle is led to a canister 4 via a vapor passage 2 that constitutes a first passage, and adsorbed by active carbon 4A in the canister 4.

Figure 2:
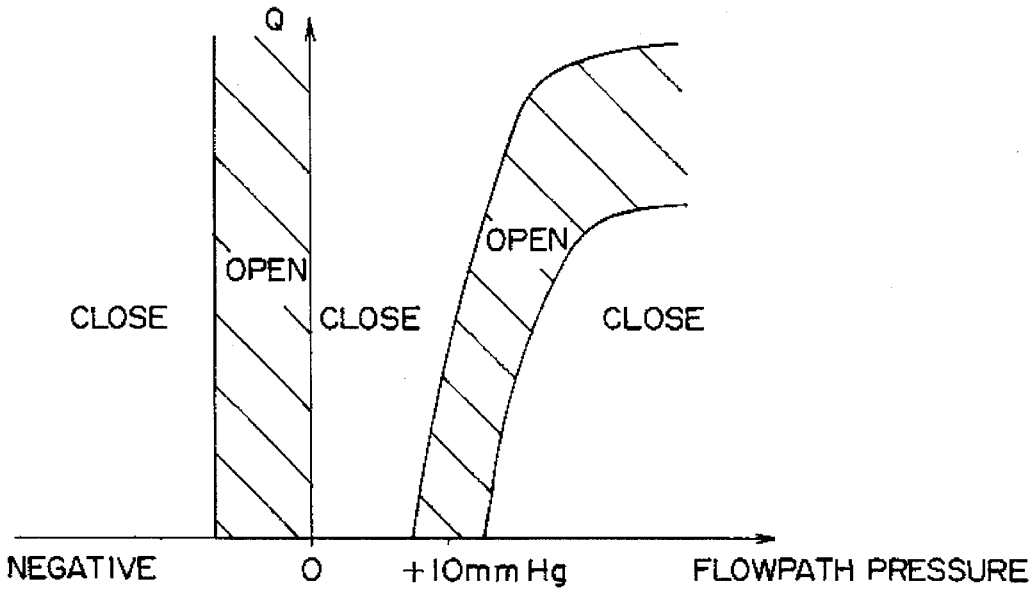
FIG. 2 is a graph showing the flowrate characteristics of a pressure control valve according to the first embodiment of this invention.
Figure 3:
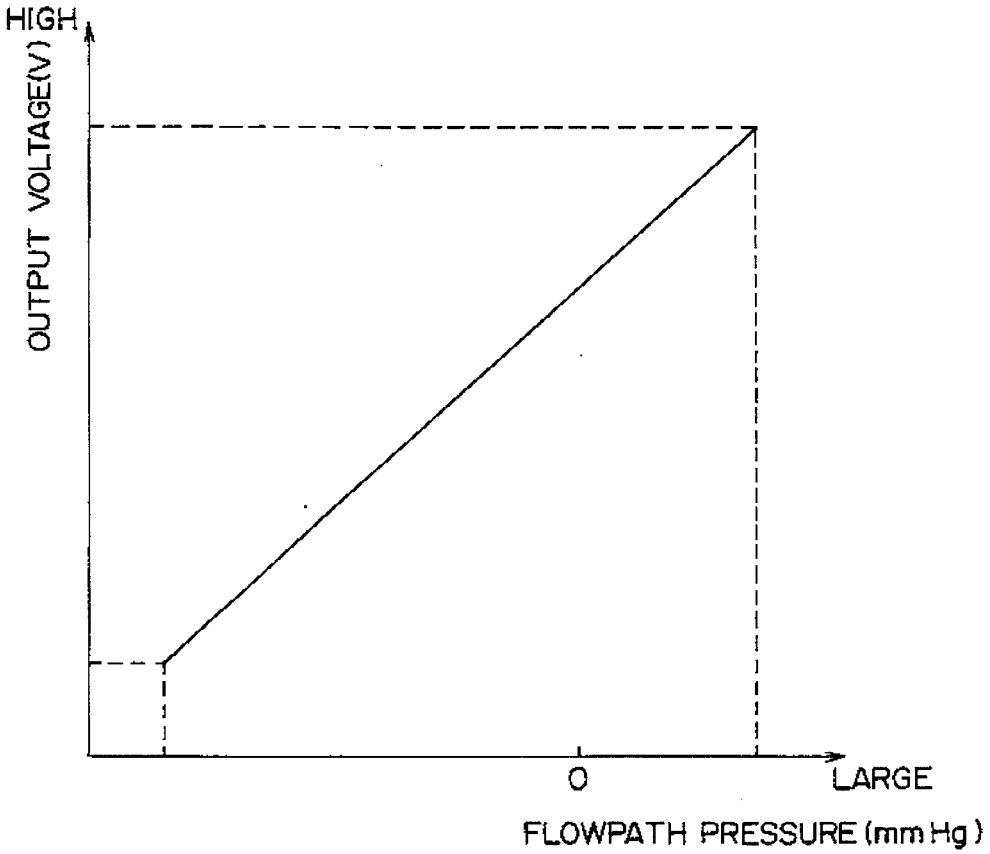
FIG. 3 is a graph showing output characteristics of a pressure sensor according to the first embodiment of this invention.

A pressure control valve 3 is provided in the vapor passage 2 as a fourth valve. The pressure control valve 3 has a mechanical construction that allows it to open when the pressure in the fuel tank 1 is lower than atmospheric, and when it is 10 mmHg higher than atmospheric, as shown in FIG. 2. In FIG. 2, atmospheric pressure is taken as a reference, i.e. as 0 mmHg. Pressures higher than atmospheric are therefore [+], and pressures lower than atmospheric are [−]. All pressures hereinafter are expressed according to this convention.

The canister 4 is connected to an air intake pipe 8 of an engine downstream of an intake throttle 7 via a purge passage 6 that constitutes a second passage. The purge passage 6 is provided with a purge cut valve 9, consisting of a diaphragm actuator 9A and three-way electromagnetic valve 9B, as a second valve. This purge cut valve 9 is normally shut.

When the electromagnetic valve 9B is OFF, the diaphragm is pushed towards the lower part of the figure by the force of a return spring of the diaphragm actuator 9A so as to close the purge passage 6. When the electromagnetic valve 9B is ON, intake negative pressure is led to a negative pressure working chamber of the diaphragm actuator 9B, the diaphragm moves to the upper part of the figure against the force of the return spring due to this negative pressure, and the purge passage 6 opens. The valve 9B is made to open and close by a signal from a control unit 21.

A purge control valve 11 driven by a step motor is provided in series with the purge cut valve 9 in the purge passage 6, this valve 11 normally being shut. The purge control valve 11 is made to open and close by a signal from the control unit 21. For example, if the purge valve 11 is opened on low load as for example after warm-up, etc., fresh air is led into the canister 4 from a fresh air inlet passage 5 attached to the canister 4 due to the intake negative pressure generated downstream of the throttle 7. Due to this influx of fresh air into the canister 4, vaporized fuel adsorbed on the active carbon 4A is discharged from the carbon, enters the intake pipe 8 together with the fresh air, and is burnt in the combustion chamber. During this purge, the purge cut valve 9 is of course opened.

The reason for providing the two valves 9 and 11 in the purge passage 6 is that even if the purge control valve 11 remains open due to a fault, the purge cut valve 9 that is normally shut obstructs the purge passage 6 so that purge gas is not led into the intake pipe 8 except under purge conditions.

The purge control valve 11 functions as a variable orifice during leak tests using negative pressure that are described hereinafter.

An air supply valve 12 that is normally closed is provided in the fresh air inlet passage 5 as a third valve. During leak tests, the air supply valve 12 is closed by a signal from the control unit 21 so as to seal the passage between the purge cut valve 9 and fuel tank 1.

Figure 13:
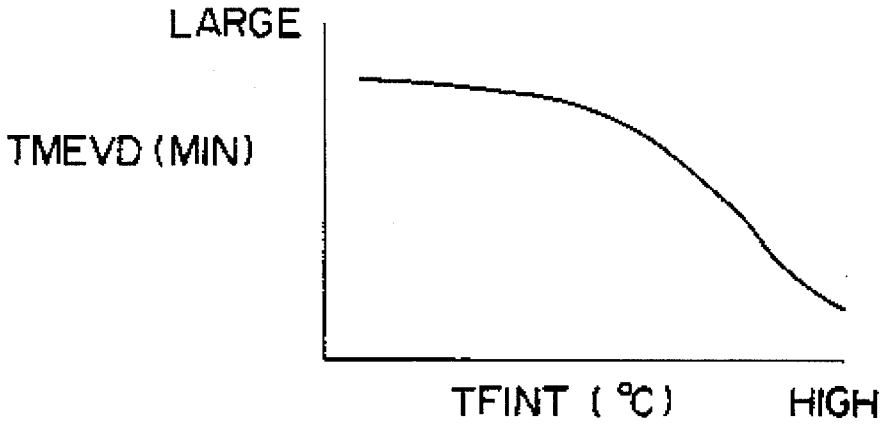
FIG. 13 is a graph showing TMEVD characteristics according to the first embodiment of this invention.

A pressure sensor 13 is provided in the purge passage 6 between the canister 4 and purge cut valve 9. The pressure sensor 13 outputs a voltage proportional to the pressure (relative pressure based on atmospheric) in the flowpath, which is sealed during leak tests. The output characteristics of the pressure sensor 13 are shown in FIG. 13. A fuel temperature sensor 15 is provided in the fuel tank 1.

A by-pass valve 14, normally closed, is provided as a first valve in parallel with the pressure control valve 3 in the vaporized fuel passage 2. The by-pass valve 14 connects the fuel tank 1 and canister 4 in order to lead positive pressure (about +10 mmHg above) in the fuel tank 1 into the canister 4, and to lead negative pressure in the canister 4 into the fuel tank 1, when the pressure control valve 3 is closed. The by-pass valve 14 is opened and closed by a signal from the control unit 21.

The control unit 21 comprises a microprocessor, and it tests for fuel leaks when the engine is running by opening and closing the purge cut valve 9, purge control valve 11, air supply valve 12 and by-pass valve 14.

This leak test may be performed at a frequency of, for example, once in one journey of the vehicle. The leak test is performed using fuel vapor pressure (positive pressure) that is generated when there is a fuel temperature rise due to operation of the vehicle, and if the necessary positive pressure cannot be obtained, it is performed using intake negative pressure.

An outline of the test will now be given, followed by a specific process description.

(1) Outline of leak test using positive pressure

When there is a rise of fuel temperature after engine start-up, under normal conditions, part of the fuel in the tank 1 vaporizes. As the pressure control valve 3 can maintain a positive pressure in the fuel tank 1 up to approx. +10 mmHg, the fuel tank 1 will be under a positive pressure if vaporized fuel is generated provided there is no leak in the tank. The method of conducting a leak test using positive pressure will now be described with reference to FIG. 4.

(i) Assuming that the tank pressure has risen, the purge cut valve 9 and purge control valve 11 are closed and purge is temporarily interrupted. Due to the closing of the two valves 9 and 11, intake negative pressure ceases to act on the vapor passage 2 and the canister 4. At the same time, air enters the flowpath from the air supply valve 12 which is open, so the pressure in the flowpath returns to atmospheric.

(ii) A few seconds after the valves 9 and 11 are closed, the air supply valve 12 is closed so that the flowpath between the fuel tank 1 and purge cut valve 9 is sealed.

(iii) One second after closing the air supply valve 12, the by-pass valve 14 is opened so as to connect the fuel tank 1 with the canister 4, and the pressure P in the flowpath is detected by the pressure sensor 13.

(iv) If the flowpath pressure P does not rise above a predetermined value $p_1$ (where $p_1$<+10 mmHg), it can be conjectured either that there is a leak in the fuel tank 1, or vaporized fuel was not produced in the fuel tank 1. In this case, a leak test is performed using intake negative pressure described hereinafter.

(v) If on the other hand the flowpath pressure P rises above the predetermined pressure $p_1$, this flowpath pressure is sampled as a first pressure $DP_1$. This means that a positive pressure higher than the predetermined value $p_1$ was maintained In the fuel tank, and leads to the conclusion that the fuel tank 1 has no leak.

(vi) The by-pass valve 14 is then closed, the flowpath pressure at a predetermined time $t_2$ (e.g. 6 seconds) after closing the by-pass valve 14 is sampled as a second pressure $DP_2$, and a leak parameter $AL_1$ is calculated from the following equation.

$$AL_1[mmHg]=DP_1-DP_2 \qquad \text{Equation 1}$$

Figure 4:
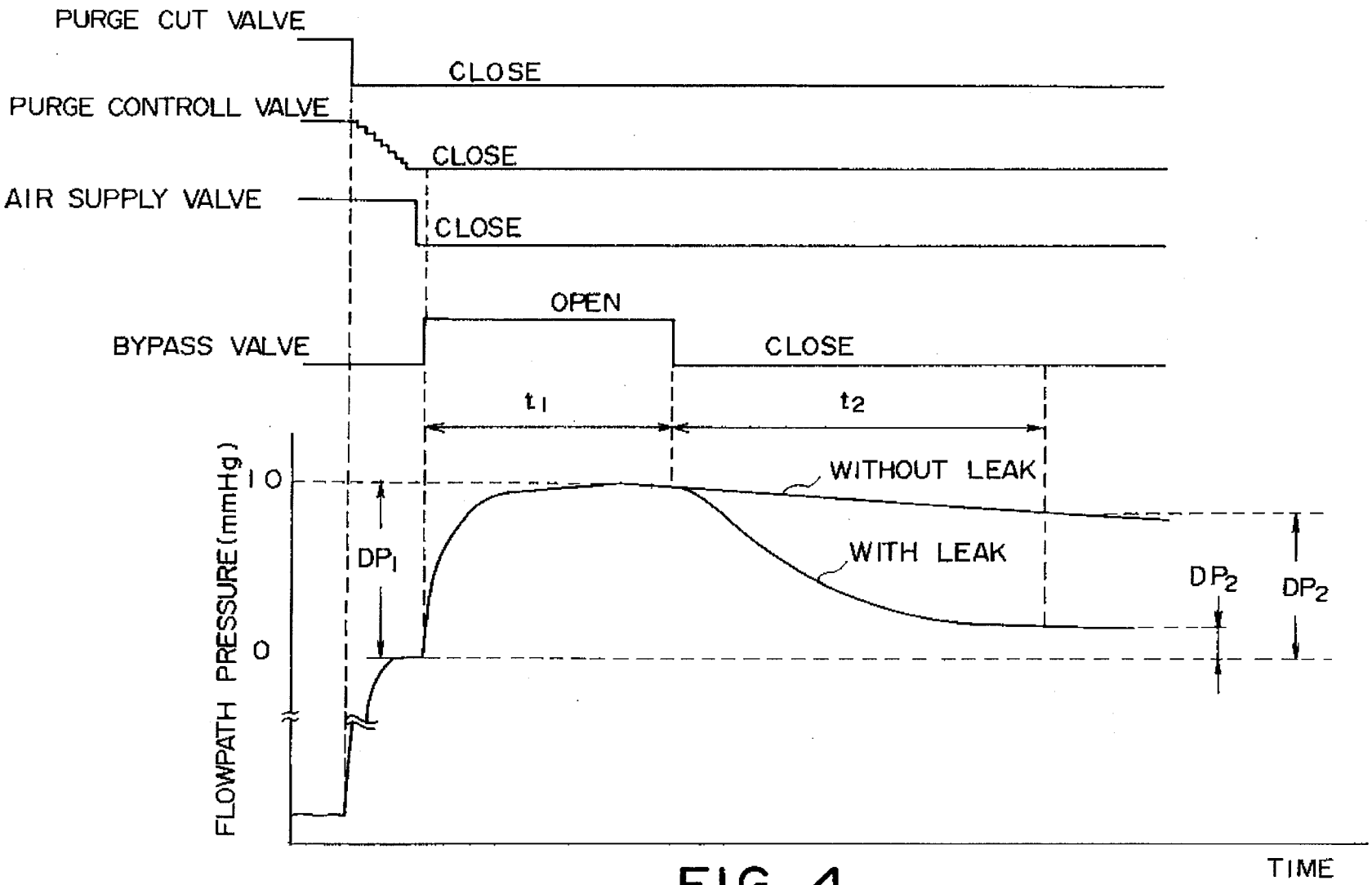
FIG. 4 is a diagram showing a pressure change in a flowpath during leak test using positive pressure, according to the first embodiment of this invention.

(vii) This leak parameter $AL_1$ is compared with a reference value $c_1$ [mmHg]. As shown in FIG. 4, when there is a leak, the value of $DP_2$ is small and the value of $AL_1$ is large. When there is no leak the value of $DP_2$ is large and the value of $AL_1$ is small. It is therefore determined that when $AL_1 \geqq c_1$ there is a leak, and when $AL_1 < c_1$ there is no leak. The reference value $c_1$ is set as follows. A leak hole having a predetermined opening surface area is formed, and the value of $AL_1$ is found experimentally. The reference value $c_1$ is then set between this value and the value of $AL_1$ when there is no leak. When $AL_1$ has risen above the reference value $c_1$, a diagnosis code is set to a value indicating that there is a leak, and this code is stored even after stopping the engine.

(2) Outline of leak test using intake negative pressure

Figure 5:
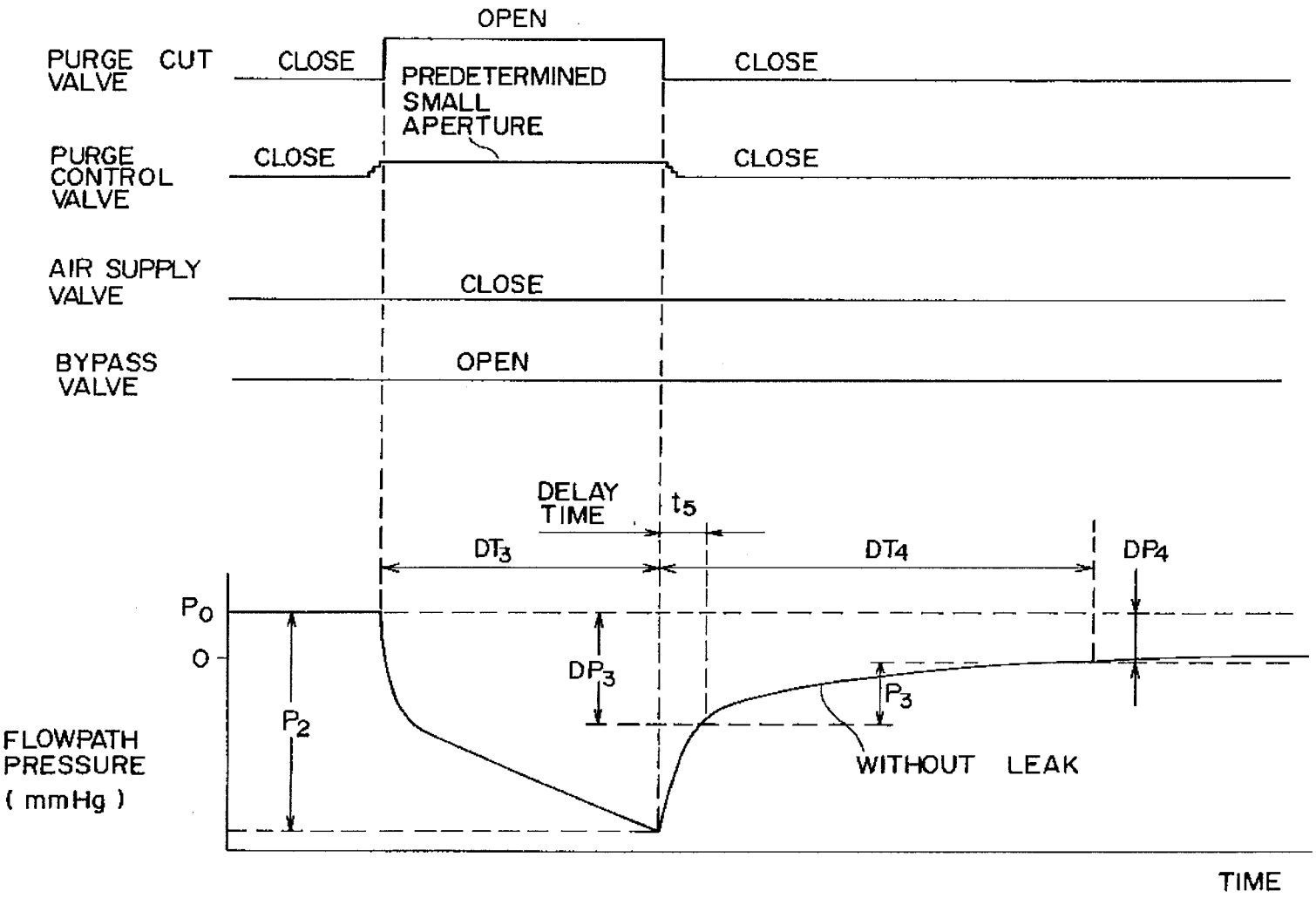
FIG. 5 is a diagram showing the pressure change in the flowpath when there is no leak during a leak test using negative pressure, according to the first embodiment of this invention.
Figure 6:
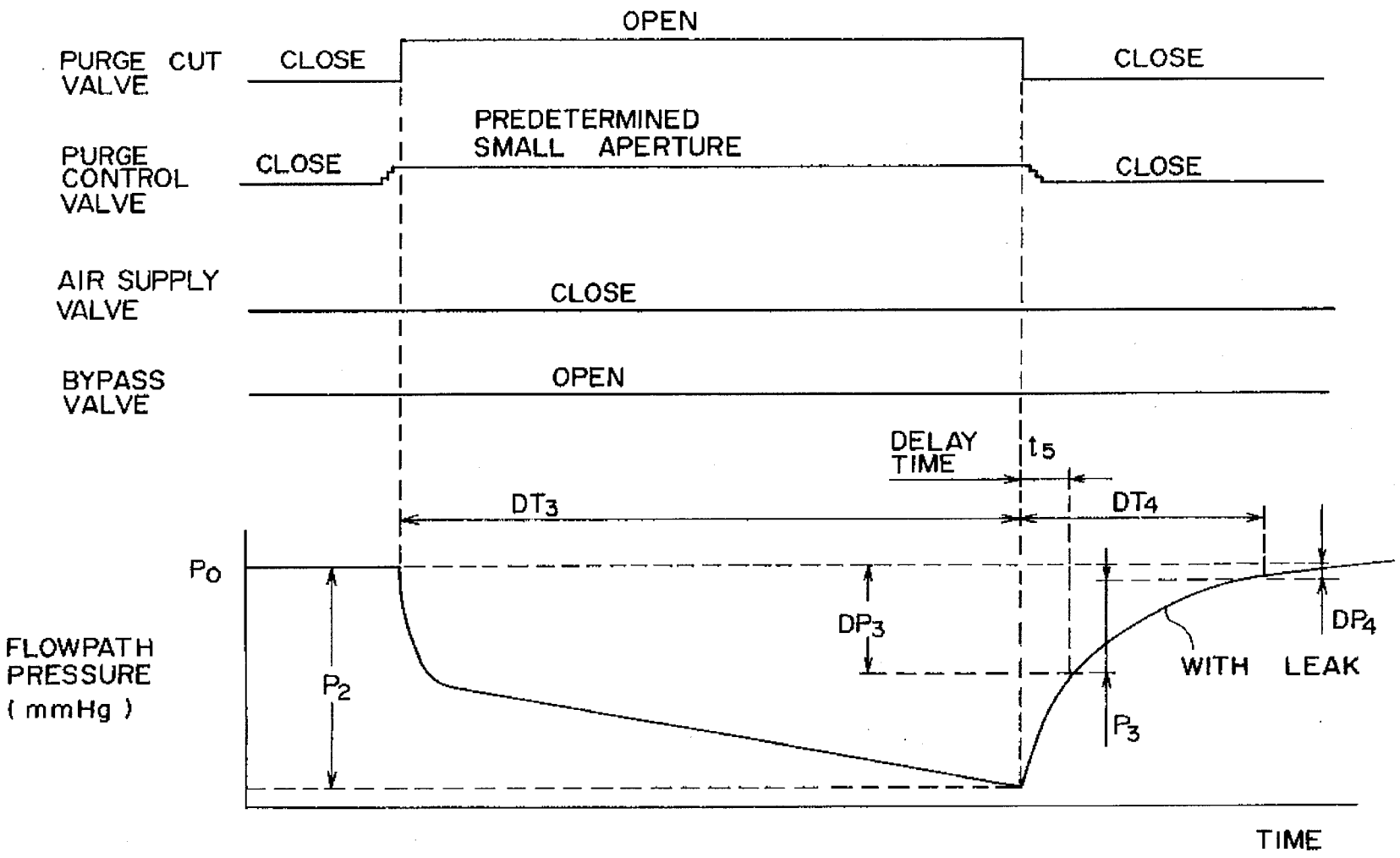
FIG. 6 is similar to FIG. 5, but showing the pressure change in the flowpath when there is a leak.

The leak test using negative pressure will be described with reference to FIGS. 5 and 6. FIG. 5 is the case when there is no leak, FIG. 6 is the case when there is a leak.

(i) If the negative pressure has fallen to below, for example, −300 mmHg, it is determined that the conditions are suitable for performing a test. The purge cut valve 9 is closed, purge is temporarily interrupted, the by-pass valve 14 is opened, and the air supply valve 12 is closed so as to seal the flowpath from the fuel tank 1 to the purge cut valve 9.

(ii) The purge control valve 11 is set to a predetermined small opening at which the flowrate is, for example, several liters per minute as compared to the maximum opening during purge control. The flowrate pressure P is stored as an initial pressure $P_0$.

(iii) The purge cut valve 9 is opened so that the pressure in the flowpath from the fuel tank 1 to the purge cut valve 9 is reduced to negative.

(iv) If the pressure differential $P_0$–P between the initial pressure $P_0$ and flowrate pressure P reaches a predetermined value $p_2$, the elapsed time from when pressure reduction was begun is sampled as a pull-down time $DT_3$ [sec], and the purge cut valve 9 is closed. If a predetermined time $t_4$ from starting pressure reduction (set to several minutes) elapses without $P_0$–P reaching $p_2$, this value is sampled as $DT_3$. During pressure reduction, the intake negative pressure must always be greater than a predetermined value. $p_2$ is set to +several 10 mmHg, and the intake negative pressure required is such that the absolute value of the pressure is much smaller than the intake negative pressure.

(v) After closing the purge cut valve 9, the gas/low stops. When a time $t_5$ required for pressure loss to stop (e.g. several seconds) has elapsed, $P_0$–P is sampled as a third pressure (pull-down pressure) $DP_3$ [mmHg]. $DP_3$ indicates the actual result of pressure reduction.

(vi) When P–$DP_3$ has reached a predetermined value $p_3$ (e.g. +several mmHg), $P_0$–P is sampled as a fourth pressure (recovery pressure) $DP_4$ [mmHg]. The time from closing the purge cut valve 9 to sampling the fourth pressure $DP_4$, is sampled as a recovery time $DT_4$ [sec]. If a predetermined time $t_4$ elapses from when the purge cut valve 9 is closed without P–$DP_3$ reaching the predetermined value $p_3$, P–P at that time is sampled as $DP_4$ and $t_4$ is sampled as $DT_4$.

(vii) A leak hole surface area $AL_2$ [$mm^2$] is calculated from the sampled pressures $DP_3$, $DP_4$ and the sampled times $DT_3$, $DT_4$ by means of the following equations.

$$AL_2 = K * A' \qquad \text{Equation 2}$$

$$A' = C * \left(\frac{DT_3}{DT_4}\right) * Ac * \frac{(\sqrt{DP_3} - \sqrt{DP_4})}{DP_3} \qquad \text{Equation 3}$$

where:

Ac=orifice surface area [$mm^2$] of purge control valve during pressure reduction.

C=correction coefficient for adjusting units (e.g. 26.6957)

K=correction coefficient=f(Ac/A')

This equation may be described as follows.

Considering such a model that the empty volume of the fuel tank 1 is Vt, and gas from the fuel tank 1 at atmospheric pressure is aspirated through an orifice by a strong intake negative pressure, then the empty volume Vt [liter] may then be found from:

$$Vt = C_1 * DT_3 * Ac * \frac{\sqrt{T}}{DP_3} \qquad \text{Equation 4}$$

where, $C_1$=constant

T=absolute temperature [°K.]

This equation holds when it is assumed that there are no leaks.

Now consider a model (leak model) wherein the empty volume is Vt, and air enters the fuel tank 1 under a constant load from the atmosphere via a leak hole. The leak hole surface area AL [$mm^2$] in this model may be found from the following equation.

$$AL = C_2 * Vt * \frac{(\sqrt{DP_3} - \sqrt{DP_4})}{\sqrt{T} * DT_4} \qquad \text{Equation 5}$$

where, $C_2$=constant

Eliminating the empty volume Vt from Equations 4 and 5, the following equation is obtained:

$$AL = C * \frac{DT_3}{DT_4} * Ac * \frac{(\sqrt{DP_3} - \sqrt{DP_4})}{DP_3} \qquad \text{Equation 6}$$

Equation 6 applies when it is determined that there are no leaks during pull-down. AL in Equation 6 is set equal to A', and a correction coefficient K for calculating the real leak hole surface area AL is then defined by the following equation.

$$AL \equiv K*A' \qquad \text{Equation 7}$$

From this equation It will be understood, from a consideration of K, that K is determined according to Ac/A'.

(viii) The leak hole surface area $AL_2$ is compared with the reference value $c_2$, and it is determined whether or not an alarm lamp should be lit. A leak hole having a predetermined opening surface area is provided, the value of $AL_2$ is determined experimentally, and the reference value $c_2$ is set between this value and the value of $AL_2$ when there is no leak.

When $AL_2$ has reached the reference value $c_2$ or higher, the control unit 21 sets the diagnosis code to a value indicating that there is a leak, and this code is stored even after the engine has stopped.

(ix) If a state persists where the test conditions in (i) are not satisfied, due to continued deceleration or acceleration for example, for a predetermined time $t_3$ (e.g. several minutes) or longer, the positive pressure test described in (1) is again attempted.

Next, the aforesaid leak test processes (1) and (2) will be described in detail with reference to FIGS. 7–10.

Figure 7:
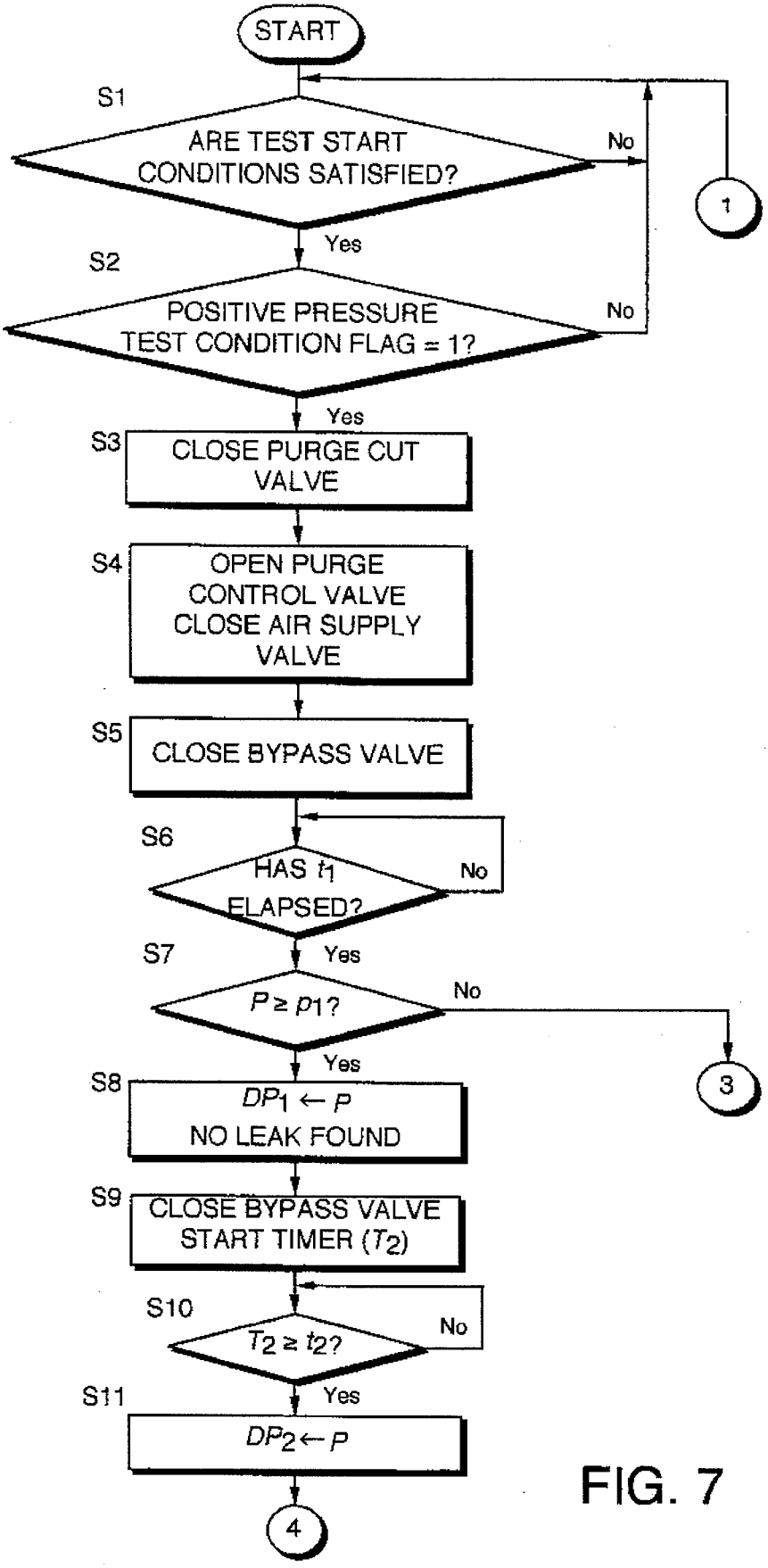
FIG. 7 is a flowchart showing a part of a leak test process according to the first embodiment of this invention.

In a step S1 in FIG. 7, it is determined whether or not the test start conditions are satisfied. The test start conditions are for example that the pressure sensor 13 is functioning normally, and that there are no faults in valves such as the air supply valve 12 and by-pass valve 14.

In a step S2 it is determined, from a positive pressure test condition flag, whether or not the positive pressure test conditions are satisfied. If the positive pressure test condition flag is "1", in a step S3, the purge cut valve 9 is closed and purge is interrupted. The positive pressure test condition flag will be described hereinafter. The step S2 constitutes a first determining means.

In steps S4, S5, after closing the purge control valve 1 and air supply valve 12, the by-pass valve 14 is opened, and in a step S6, it is determined whether or not a predetermined time $t_1$ has elapsed from when the by-pass valve 14 was opened. $t_1$ is set to, for example, several seconds. The steps S3–S5 constitute a first operating means.

If $t_1$ has elapsed, in a step S7, the flowrate pressure P at that time is compared with a predetermined value $p_1$, and if $P \geqq p_1$, this flowrate pressure P is entered in a parameter $DP_1$ that indicates the first pressure in a step S8, and it is determined that there is no leak in the fuel tank 1. $p_1$ is set to +several mmHg. The steps S7 and S8 constitute a second determining means. Further, the step S8 is a first pressure sampling means.

When $P<p_1$. the leak test using positive pressure cannot be performed, so the routine shifts to a leak test using negative pressure described hereinafter.

In a step S9, the by-pass valve 14 is closed and a timer is started. This timer value $T_2$ measures the time elapsed from closing the by-pass valve 14. The step S9 constitutes a second operating means.

step S10 the timer value $T_2$ and the predetermined time $t_2$ are compared, ad if $T_2 \geqq t_2$, in a step S11, the flowpath pressure P is entered in a parameter $DP_2$ indicating a second pressure. $t_2$ is set to, for example, 6 seconds. The steps S9, S10 constitute a first timer. The step S11 constitutes a second pressure sampling means.

Figure 8:
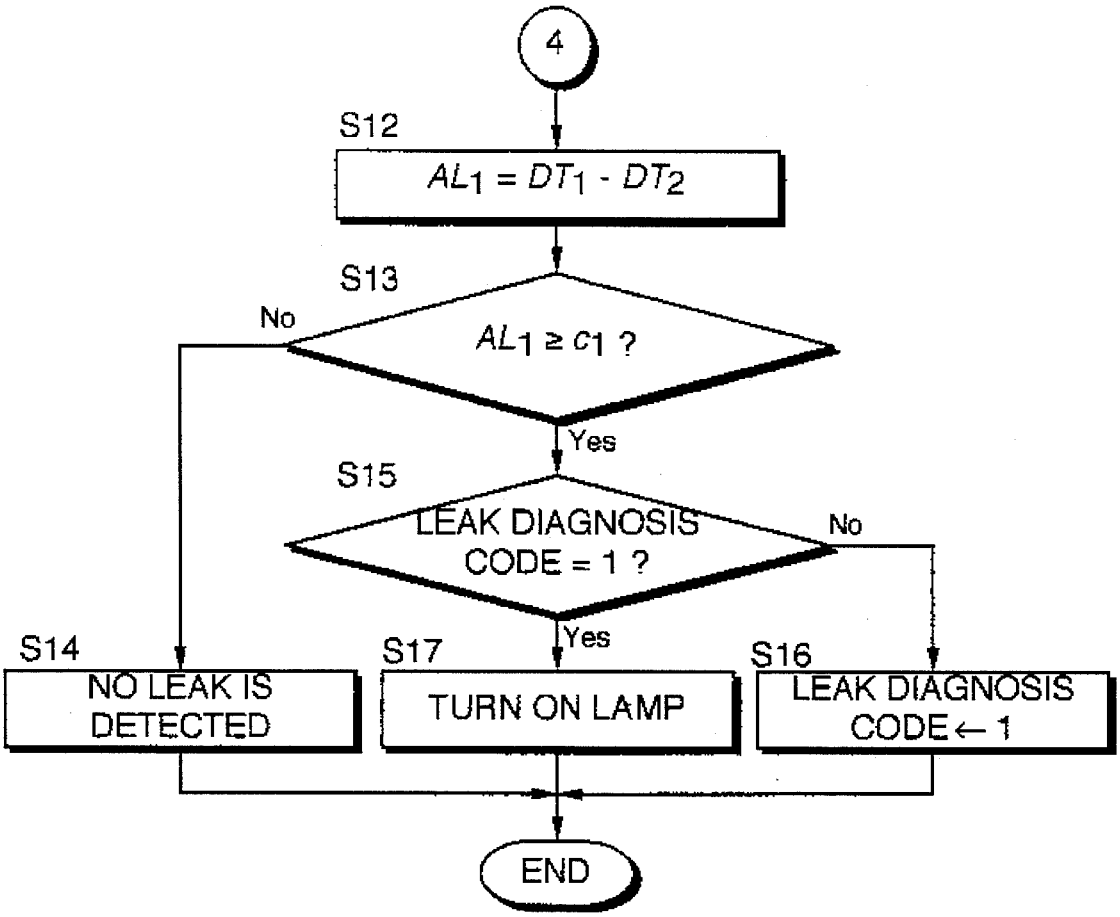
FIG. 8 is a flowchart showing another part of the leak test process.

The routine proceeds to FIG. 8, where in a step S12, the leak parameter $AL_1$ is calculated from the aforesaid equations, and in a step S13, the parameter $AL_1$ is compared with the reference value $c_1$. If $AL_1<c_1$, the leak test in this journey of the vehicle is concluded via a step S14. After the leak test is concluded, the vehicle returns to purge control.

When $AL_1 \geqq c_1$, the routine proceeds to a step S15, and the leak diagnosis code is read. If the leak diagnosis code is "0", it is determined for the first time on this occasion that there is a leak. Then, In a step S16, the leak diagnosis code is set to "1" and stored, and the leak test on this journey of the vehicle is concluded. In this case, too, the vehicle returns to purge control.

On the next journey of the vehicle, when again $AL_1 \geqq c_1$ in a test using positive pressure and the routine has reached the step S15, as the leak diagnosis code is "1", the routine proceeds to a step S17, and a warning alarm on the front panel in the driver's compartment lights. The steps S12–S17 constitute a third determining means.

Figure 9:
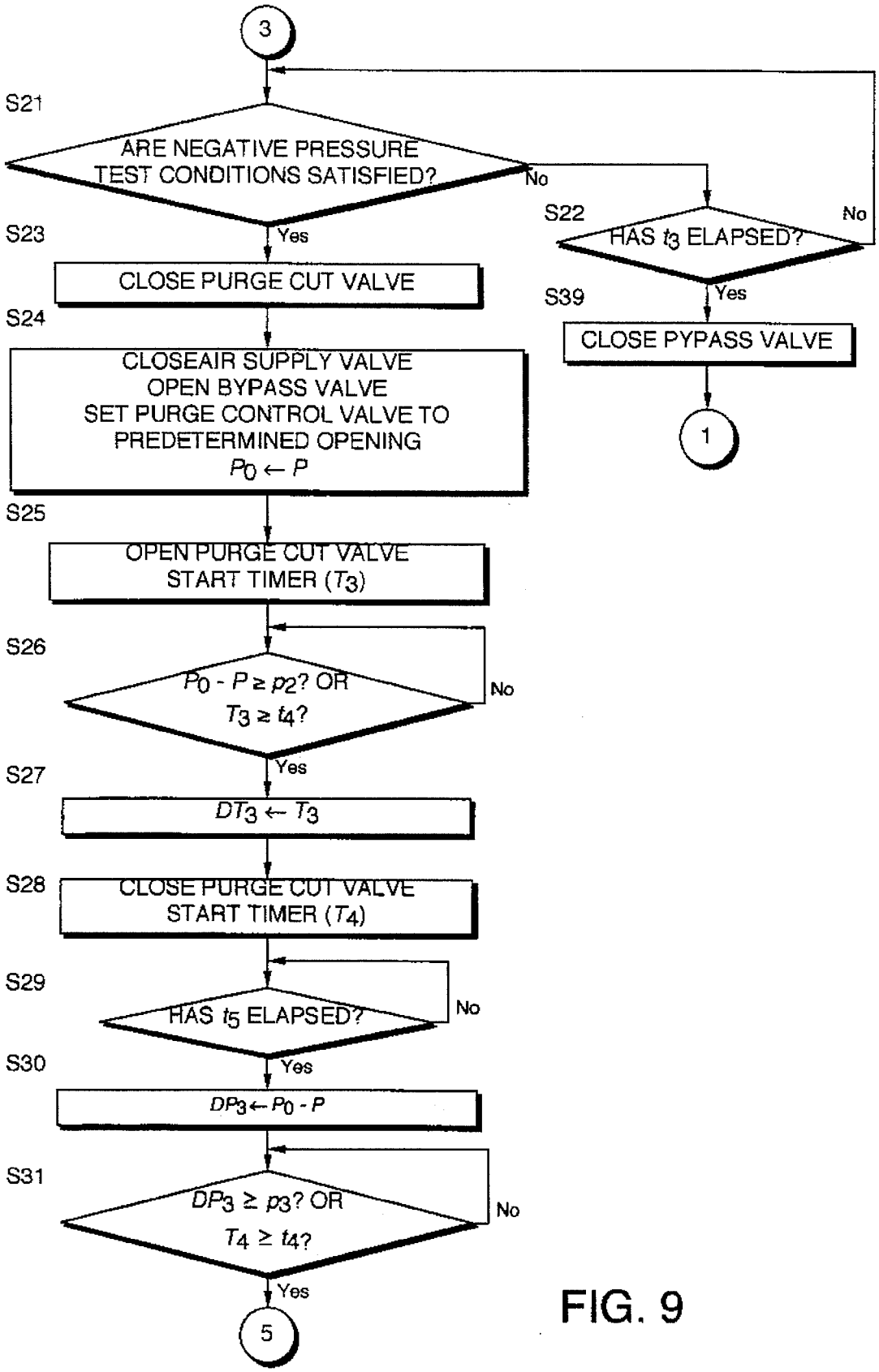
FIG. 9 is a flowchart showing still another part of the leak test process.

On the other had, If $P<p_1$ in the step S7 of FIG. 7, the routine proceeds to FIG. 9.

In FIG. 9, in a step S21, it is determined whether or not the negative pressure test conditions are satisfied. Negative pressure test conditions on a vehicle with manual gears are for example that the vehicle is in fourth or fifth gear, and that the intake negative pressure is of the order of −300 mmHg. The step S21 is a fifth determining means.

When these conditions do not hold, the routine proceeds to a step S22. In the step S22, it is determined whether or not a predetermined time $t_3$ has elapsed from when the routine first proceeded to the step S21. $t_3$ is set to several minutes. If the time $t_3$ has not elapsed, the routine returns to the step S21, and it is again determined whether or not negative pressure test conditions hold. If negative pressure test conditions do not hold even if the time $t_3$ has elapsed, the by-pass valve 14 is closed in a step S39, and the process of FIG. 7 is repeated from the beginning. Hence, instead of waiting a very long time for negative pressure test conditions to hold, the time range for determining these conditions is limited so that the test time becomes shorter. The steps S22 and S39 constitute a leak test repeat means by a second determining means.

When the negative pressure test conditions hold, in a step S23, the purge cut valve 9 is closed. In the case where purge was being performed, purge is thereby interrupted.

In a step S24, the air supply valve 12 is closed and the by-pass valve 14 is opened so as to seal the flowpath from the fuel tank 1 to the purge cut valve 9, and the purge control valve 11 is set to a small predetermined opening compared to the maximum opening during purge control. This predetermined opening is such that the flowrate is of the order of several liter/min. The flowpath pressure P at this time is then stored in the parameter $P_0$ as an initial pressure. Valve operations and substitution in parameters in the step S24 must be performed in this sequence.

In a step S25, the purge cut valve 9 is opened, and a timer is started. When the purge cut valve 9 is opened to a predetermined opening, purge gas under the intake negative pressure is aspirated toward the intake pipe 8 at a predetermined flowrate via an orifice formed by the purge control valve 11, and the flowpath pressure from the fuel tank 1 to the purge control valve 11 falls. The steps S24, S25 constitute a third operating means.

According to this embodiment, when a positive pressure remains which is less them the predetermined value $p_1$ generated in the fuel tank 1, testing immediately begins with negative pressure. To perform a leak test using negative pressure, it would be logical to start introducing negative pressure after the flowpath pressure has been restored to atmospheric. However, the restoration of flowpath pressure to atmospheric pressure requires several seconds, and if the vehicle drifts outside the negative pressure test condition range during this time, test cannot be performed. Aspiration is therefore begin immediately from the positive pressure state so that leak test by negative pressure can be started earlier.

The flowpath pressure immediately prior to introducing negative pressure is entered in the parameter $P_0$ as the initial pressure, and the leak hole surface area $AL_2$ is calculated based on the pressure change from the initial pressure $P_0$. Even if this positive pressure is different for every test, therefore, there is no effect on the accuracy of computing the leak hole surface area $AL_2$.

In the step S26, the pressure differential $P_0-P$ between the initial pressure $P_0$ and the flowpath pressure P are compared with a predetermined value $p_2$, and if $P_0-P \geqq p_2$, the routine proceeds to a step S27 where a timer value $T_3$ that measures elapsed time from when the purge cut valve 9 was opened, is entered in the parameter $DT_3$ indicating pull-down time. If $P_0-P<p_2$, the timer value $T_3$ is compared with the predetermined time $t_4$, and if $T_3 \geqq t_4$, the routine proceeds to a step S27 where the value of $T_3$ at that time is entered in the parameter $DT_3$ indicating pull-down time. $p_2$ is set to a value which is sufficiently small compared to the intake negative pressure, for example a value of the order of +several 10 mmHg. The predetermined time $t_4$ is set to several minutes or so. The steps S25–S27 constitute a second timer.

In a step S28, the purge cut valve 9 is closed and a timer is started, This timer measures the elapsed time from when the purge cut valve 9 was closed. The step S28 is a fourth operating metals.

In a step S29, it is determined whether or not a predetermined time $t_5$ has elapsed from when the purge cut valve 9 was closed. If $t_5$ has elapsed, in a step S30, the pressure differential $P_0-P$ between the initial pressure $P_0$ and the flowpath pressure P at that time is entered in the parameter $DP_3$ indicating a third pressure. $t_5$ gives the delay time for pressure loss to cease when gas flow stops after closing the purge cut valve 9, and it is set to several seconds or so. The steps S29, S30 constitute a third pressure sampling means.

Figure 10:
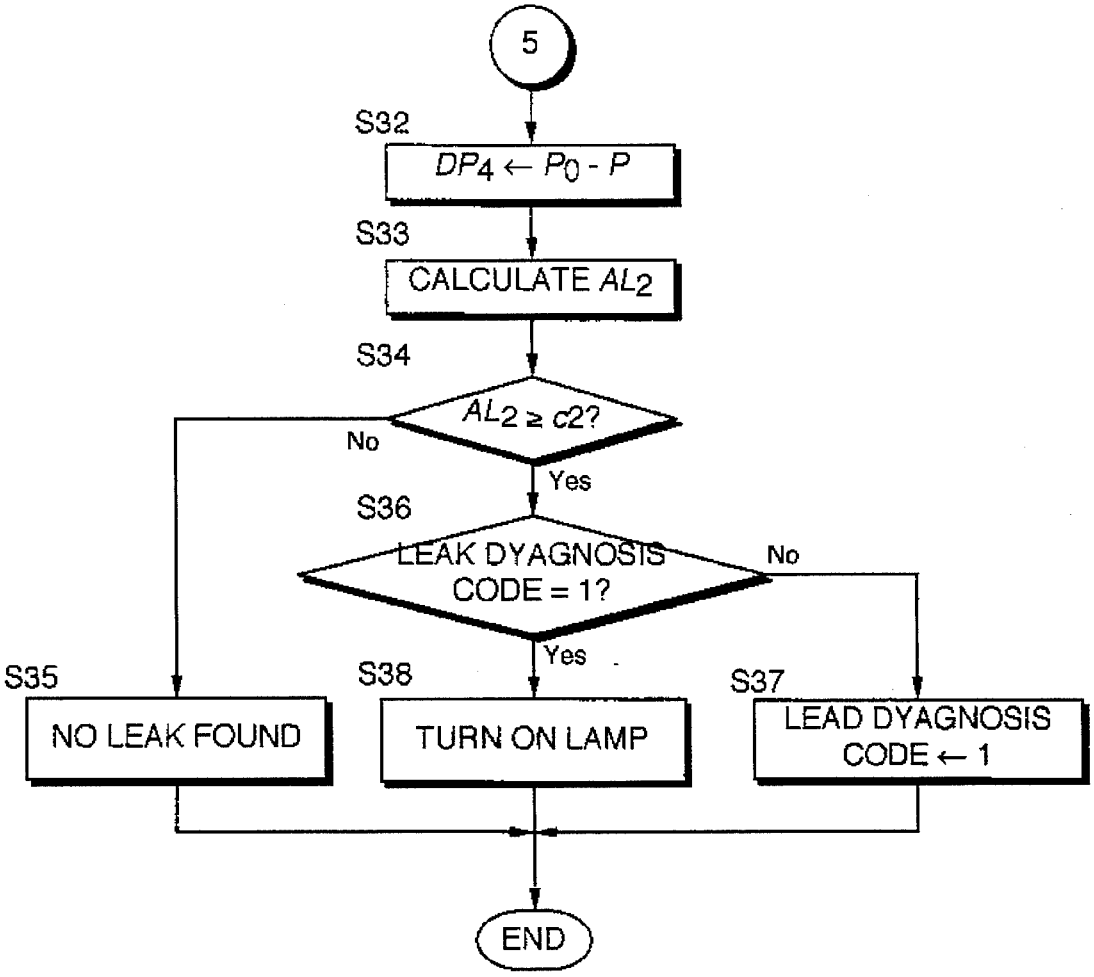
FIG. 10 is a flowchart showing yet another part of the leak test process.

In a step S31, $DP_3$ and a predetermined pressure $p_3$ are compared, and if $DP_3 \geqq p_3$, in a step S32 in FIG. 10, the pressure differential $P_0-P$ between the initial pressure $P_0$ and the flowpath pressure P at that time is entered in the parameter $DP_4$ indicating a fourth pressure. Further, the elapsed time $T_4$ from when the purge cut valve 9 is shut is entered in the parameter $DP_4$ indicating recovery time. $p_3$ is set to, for example, +several mmHg. If $DP_3<p_3$, the timer value $T_4$ is compared with the predetermined time $t_4$, and if $T_4 \geqq t_4$, the routine proceeds to a step S32 where the value of $T_4$ at that time is entered in the parameter $DT_4$, and the value of the flowrate pressure P is entered in the parameter $DP_4$.

The steps S31, S32 constitute a fourth pressure sampling means. Sampling of four values, i.e. two pressures and two times, is thereby concluded. Further, the steps S28–S32 constitute a third timer.

In a step S33 shown in FIG. 10, the leak hole surface area $AL_2$ is calculated by means of the aforesaid equations from the four sampling values (i.e. the values in the parameters $DP_3$, $DP_4$ and the parameters $DT_3$, $DT_4$). The step S33 constitutes a leak hole surface area computing means.

The routine from the step S34 to the step S38 is identical to the routine from the step S13 to the step S17 of FIG. 8. However, in the test using negative pressure, higher accuracy is obtained as the leak hole surface area $AL_2$ is calculated. The steps S34–S38 constitute a sixth determining means, and the entire process in the steps S26–S38 constitute a fourth determining means.

Hence, the by-pass valve 14 is opened, the purge cut valve 9 and air supply valve 12 are closed so as to seal the flowpath (second flowpath section) from the fuel tank 1 to the purge cut valve 9, and if the flowpath pressure P is greater than the predetermined value $p_1$ it is determined that there is no leak in the fuel tank 1. This procedure determines the presence or absence of a leak in the fuel tank 1.

Further, the flowpath pressure when this pressure is above the predetermined value $p_1$ is taken as a first pressure $DP_1$, and the flowpath pressure after a predetermined time $t_2$ has elapsed from when the by-pass valve 14 was closed is sampled as a second pressure $DP_2$, and it is determined whether or not there is a leak based on the pressures $DP_2$, $DP_1$. This procedure determines the presence or absence of a leak in the section (first flowpath section) from the by-pass valve 14 to the purge cut valve 9.

Still further, when the flowpath pressure P does not exceed the predetermined value $p_1$ and a leak test is performed using negative pressure, a leak test may be performed when sufficient positive pressure has not developed in the fuel tank.

According to this method, compared to the test where only negative pressure is used, the frequency with which negative pressure acts on the vaporized fuel treatment mechanism is minimized. Further, the predetermined value $p_2$ is set to +several 10 mmHg which is much smaller than the intake negative pressure, and when $P_0$–P is greater than $p_2$, the purge cut valve 9 is closed so that a strong negative pressure does not act on the mechanism. A situation is therefore maintained wherein valves and other instruments are not easily damaged.

If the conditions for test using negative pressure are not satisfied even after the predetermined time $t_3$ has elapsed, the test again uses positive pressure, so the test time is not too long.

In this test, four values are sampled, i.e. the time from when negative pressure is introduced to when $P_0$–P exceeds the predetermined value $p_2$ is sampled as a pull-down time $DT_3$, the pressure differential between the flowpath pressure P when a predetermined delay time $t_5$ has elapsed from when the pressure starts to rise and the initial pressure $P_0$ is sampled as a third pressure (pull-down pressure) $DP_3$, the pressure differential between the flowpath pressure when this pressure $DP_3$ exceeds the predetermined value $p_3$ and the initial pressure $P_0$ is sampled as a fourth pressure (recovery pressure) $DP_4$, and the time from when the pressure starts rising to when the third pressure $DP_3$ reaches the predetermined value $p_3$, is sampled as a recovery time $DT_4$. The leak hole surface area $AL_2$ in the flowpath from the fuel tank 1 to the purge cut valve 9 is computed, and $AL_2$ is then compared with the reference value $c_2$. When $AL_2$ is less than $c_2$ it is determined that there is no leak, while if $AL_2$ is equal to or greater than $c_2$, it is determined that there is a leak. Hence, as the leak test depends on estimating the leak hole surface area, the test is very precise.

Figure 11:
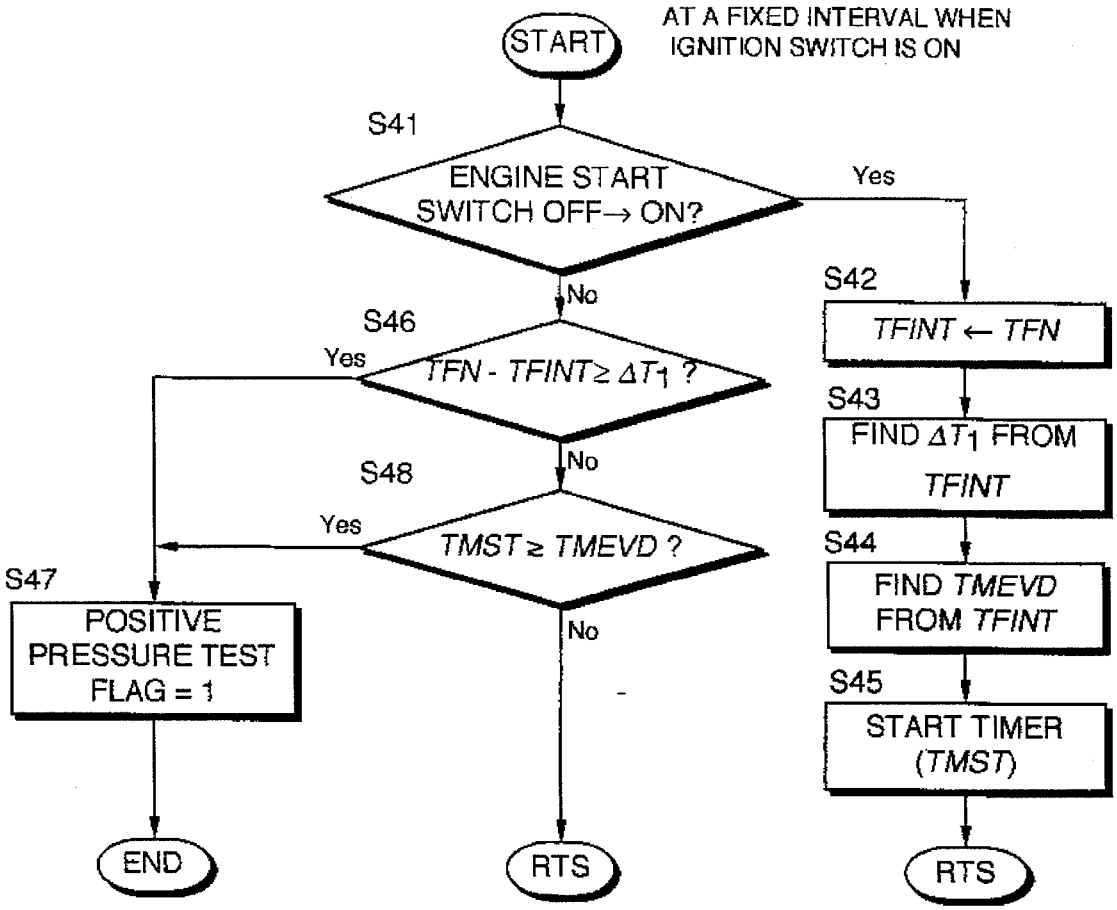
FIG. 11 is a flowchart showing a determining process under positive pressure test conditions according to the first embodiment of this invention.

FIG. 11 is a flowchart for deciding whether or not positive pressure test conditions hold. According to this process, when an ignition switch of the engine is ON, the test is performed at fixed intervals.

In a step S41, when a start switch of the engine is switched from OFF to ON, it is determined that the vehicle has started, and in a step S42, a fuel temperature TFN detected by a fuel temperature sensor 15 is entered in a parameter TFINT. The parameter TFINT therefore contains the fuel temperature on start-up.

Figure 12:
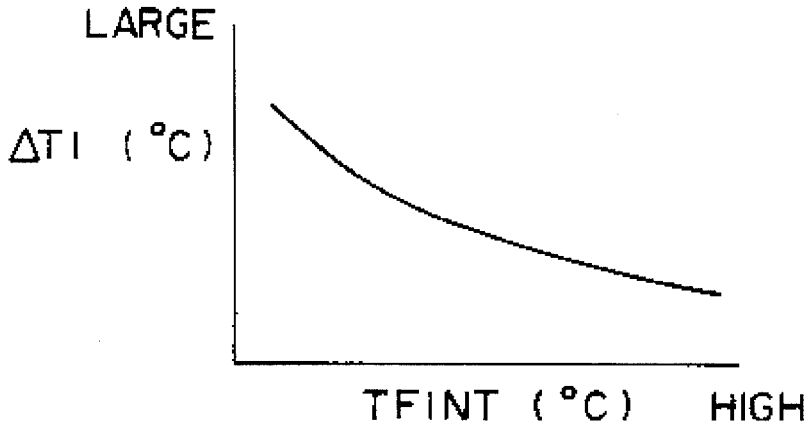
FIG. 12 is a graph showing $\Delta T_1$ characteristics according to the first embodiment of this invention.

In steps S43, S44, predetermined values $\Delta T_1$ [°C.] and TMEVD [min] are found from this value of TFINT by looking up tables containing the data of FIG. 12 and FIG. 13, and in a step S45 a timer is started. This timer value TMST indicates the time elapsed from the start.

In the next control period, the routine proceeds from the step S41 to the step S46, and the temperature differential TFN–TFINT between the current fuel temperature and the fuel temperature on start-up is compared with the predetermined value $\Delta T_1$. If TFN–TFINT$\geqq\Delta T_1$, it is determined that the fuel temperature rise from start-up is large, and in a step S47, a positive pressure test flag is set to "1".

The initial setting of the positive pressure test flag on start-up is "0". In order to obtain a positive pressure above, for example, +5 mmHg that is required for the test, fuel has to evaporate rapidly in the fuel tank 1. When the fuel temperature rise from start-up is large, it is determined that a large amount of fuel vapor is generated, and testing therefore begins. The step S46 is an eighth determining means.

Even if TFN–TFINT$<\Delta T_1$. in a step S48, the timer value TMST is compared with the predetermined value TMEVD, and if TMST$\geqq$TMEVD, the routine proceeds to the step S47. The reason why testing is not performed until the time from start-up is equal to or greater than the predetermined value TMEVD is that fuel is vaporized during this waiting time to generate the required positive pressure for the test. The fact that TMST$\geqq$TMEVD or TFN–TFINT$\geqq\Delta T_1$ signifies that the positive pressure required for the test has been obtained due to fuel vapor in the fuel tank 1. The step S48 is a ninth determining means.

Thus, by determining whether the positive pressure required for test exists in the fuel tank 1 before beginning the test, purge can be continued right up until the test, and the time required for performing the leak test using positive pressure can be reduced.

It is of course possible to instal a pressure sensor in the section from the pressure control valve 3 to the fuel tank 1 (third flowpath section), and detect the positive pressure required for test directly with this pressure sensor. However, by determining the presence or absence of the positive pressure from the fuel temperature rise from start-up or the time elapsed from start-up, there is no need such a pressure sensor.

The predetermined value $\Delta T_1$ increases the lower is the fuel temperature on start-up, TFINT, as shown in FIG. 12. This is due to the fact that less fuel vapor is generated for the same temperature rise when the fuel temperature on start-up is lower. The predetermined value TMEVD also increases the lower is the fuel temperature on start-up, TFINT, as shown in FIG. 13. This is due to the fact that less fuel vapor is generated for the same waiting time when the fuel temperature on start-up is lower.

However, in order to simplify the process, the predetermined values $\Delta T_1$ and TMEVD may both be set equal to fixed values.

Next, a second embodiment of this invention relating to a leak test algorithm using negative pressure will be described referring to FIG. 14–19.

Regardless of leak test, when the engine is in the idle state, purging is interrupted in order to maintain drivability, and the purge cut valve 9 is closed. For example, during the process of introducing negative pressure in the steps S25–S27 of the first embodiment, when the engine is idle, introduction of negative pressure is interrupted by purge cut, so the pull-down time $DT_3$ cannot be measured until the predetermined pressure drop is achieved.

This embodiment is intended to overcome this drawback. In the following description, a pull-down time is $t_P$, a third pressure (pull-down pressure) is $DP_P$, a recovery time is $t_L$, and a fourth pressure (recovery pressure) is $DP_L$.

The control unit 21 measures the pull-down time by the following procedure.

(i) A timer starts time measurement when the first time negative pressure begins to be introduced, (ii) It is determined whether or not there was a purge cut during introduction of negative pressure, and if there was, the flowpath pressure immediately prior to the purge cut and the time $TM_P$ measured by the timer are stored.

(iii) It is determined whether or not the purge cut has finished. As soon as the purge cut is finished, introduction of negative pressure is resumed.

(iv) When introduction of negative pressure is resumed, it is determined whether or not the flowpath pressure P has dropped to below the stored value. When it has dropped below the stored value, time measurement starts again from the stored value $TM_P$.

(v) After restarting time measurement, it is determined whether or not the flowpath pressure has dropped to a target pressure $P_M$. When the flowpath pressure P has dropped to the target pressure $P_M$, the time measured by the timer is sampled as the pull-down time $t_p$.

The above process will be described referring to the flowcharts of FIG. 14 and FIG. 17.

Figure 14:
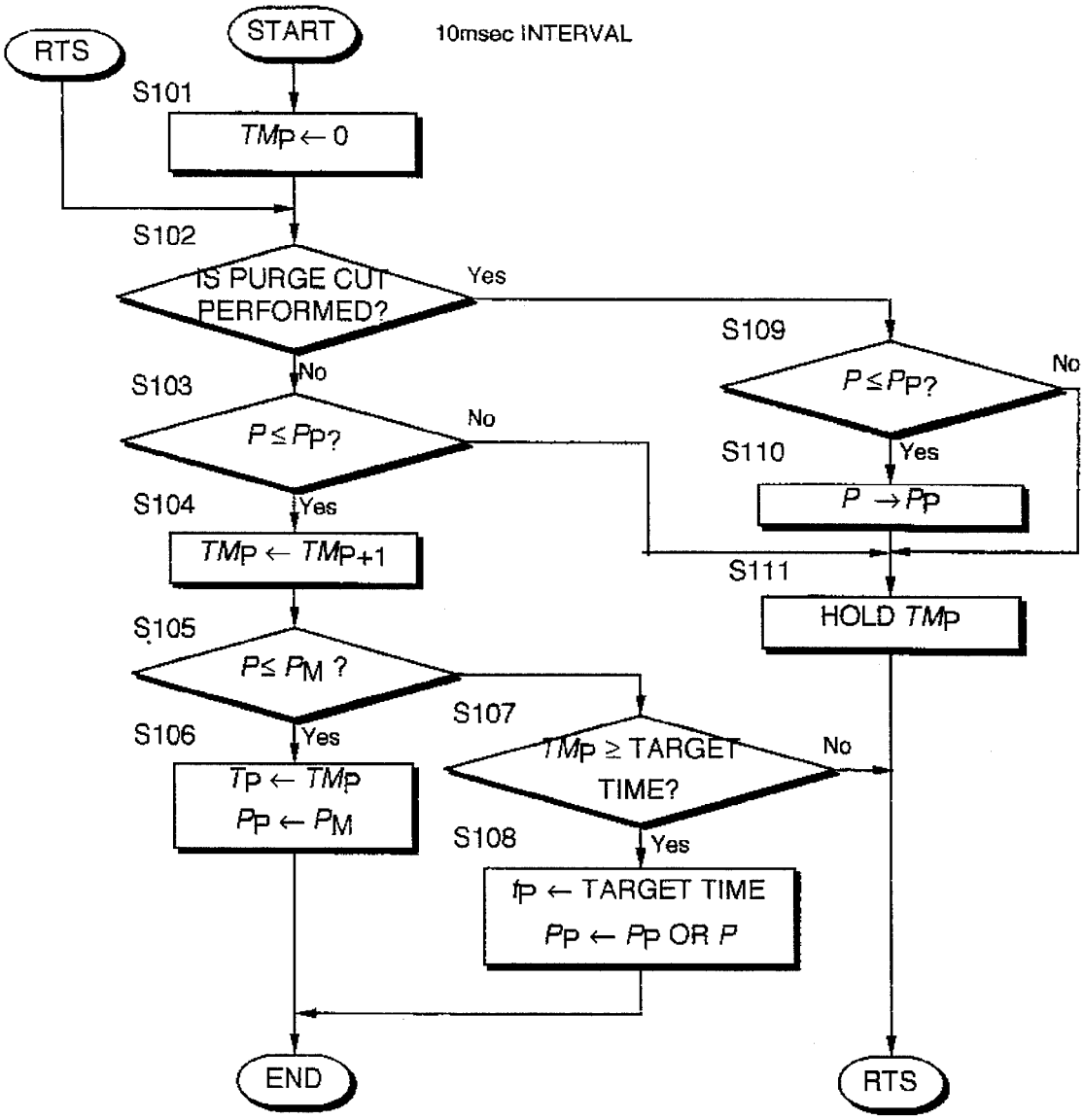
FIG. 14 is a flowchart showing a first half of a leak test process according to a second embodiment of this invention.

FIG. 14 shows the process of sampling the pull-down time $t_p$. When this process is a test condition, it may for example be performed every 10 msec.

In FIG. 14, in a step 101, the timer value $TM_P$ is cleared and returned to 0, and in a step S104. the timer value $TM_P$ is incremented. This timer value $TM_P$ is provided to measure the pull-down time.

In a step S105, the flowpath pressure P and target pressure $P_M$ (e.g. −several 10 mmHg) are compared, and when $P \leqq P_M$, in a step S106, the timer value $TM_P$ is entered in the parameter $t_p$ expressing pull-down time, $P_M$ is entered in the parameter $P_P$, and the routine of FIG. 14 is terminated.

On the other hand, when $P > P_M$ in the step S105, the timer value $TM_P$ and a target time (e.g. several minutes) are compared in a step S107. If $TM_P \geqq$target time, the target time is entered in the parameter $t_p$ in a step S108. Also, of the value of the parameter $P_P$ and the flowpath pressure P, the smaller absolute value is entered in the parameter $P_P$ and the routine is terminated.

If on the other hand the engine goes idle and purge cut occurs during pull-down, the routine proceeds to a step S109.

In the step S109, the flowpath pressure and the value of the parameter $P_P$ are compared. At first, immediately after purge cut, the parameter $P_P$ still has its initial value 0 mmHg, so if purge cut occurs during pull-down, $P \leqq P_P$. In this case, in a step S110, the flowpath pressure P is entered in the parameter $P_P$. This means that the flowpath pressure Immediately prior to purge cut is sampled in the parameter $P_P$. In a step S111, the timer value $TM_P$ is held as it is. This is because, as introduction of negative pressure is interrupted during purge cut, the interruption time is subtracted from the pull-down time.

If purge cut continues even during the next cycle, the routine advances from the step S102 to the step S109. When the purge cut valve 9 is closed due to purge cut, the flowpath pressure P gradually rises to atmospheric. This time, therefore, $P > P_P$, the routine advances to the step S111, and the timer value $TM_P$ continues to be held. This state continues until the purge cut valve 9 opens and introduction of negative pressure recommences.

When the engine is no longer idle and the purge cut valve 9 resumes introduction of negative pressure, the routine advances from the step S102 to the step S103.

Here, the flowpath pressure P and parameter $P_P$ are compared. The parameter $P_P$ at this time contains the flowpath pressure immediately prior to purge cut, and as immediately after purge cut is released the flowpath pressure has not fallen, $P > P_P$. In this case, the timer value $TM_P$ continues to be held in the step S111.

When finally $P < P_P$ due to continuing introduction of negative pressure, the timer value $TM_P$ is once again incremented in the step S104.

Figure 15:
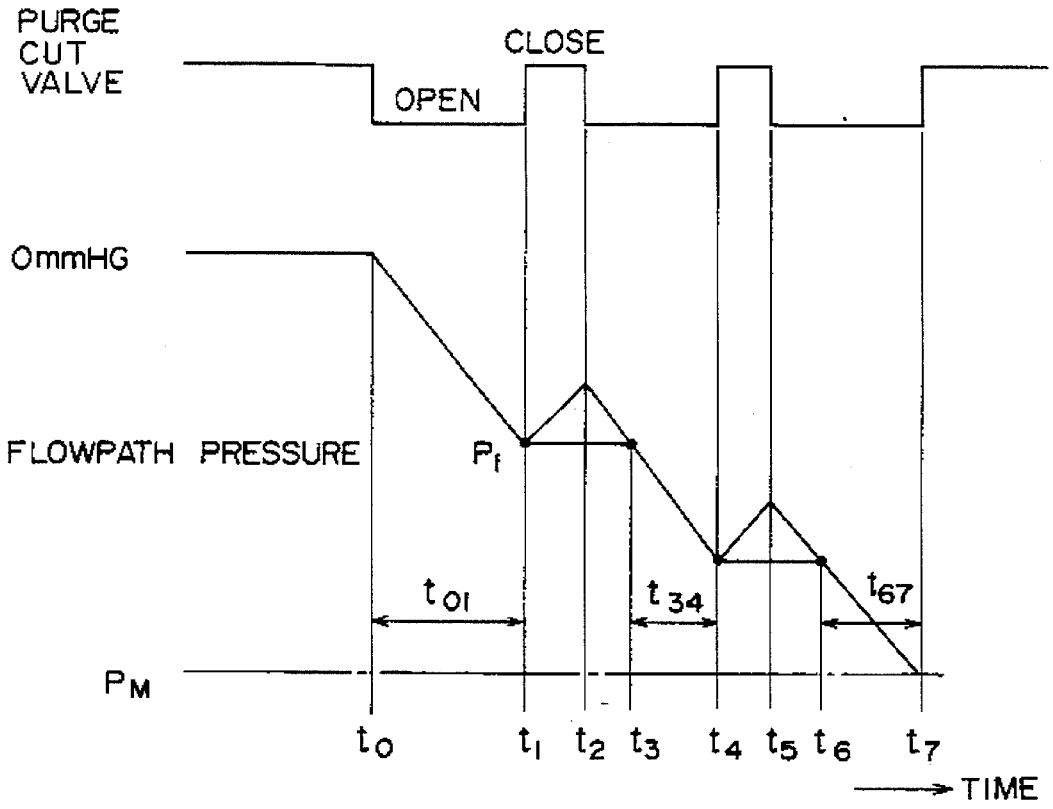
FIG. 15 is a diagram showing one form of the pressure variation when negative pressure is introduced into the flowpath, according to the second embodiment of this invention.

FIG. 15 shows a sampling pattern for pull-down time according to the above process when purge-cut occurs in the idle state while negative pressure is being introduced.

First, at a time $t_1$ when purge cut begins, a flowpath pressure $P_1$ immediately prior to purge cut is stored, and a timer value measured up to this point (i.e. $t_{01}$) is held. When the engine is no longer idle and purge cut is finished at a point $t_2$, the flowpath pressure starts to drop as introduction of negative pressure is resumed. At a point $t_3$ when the flowpath pressure P coincides with the stored pressure $P_1$, time measurement by the timer is restarted. The operation from $t_4$ to $t_6$ is the same as that from $t_1$ to $t_3$.

The timer value is the sum of $t_{01}$, $t_{34}$ and $t_{67}$ at a point $t_7$ when the flowpath pressure P reaches the target pressure $P_M$, and this sum is sampled as the pull-down time $t_p$.

Figure 16:
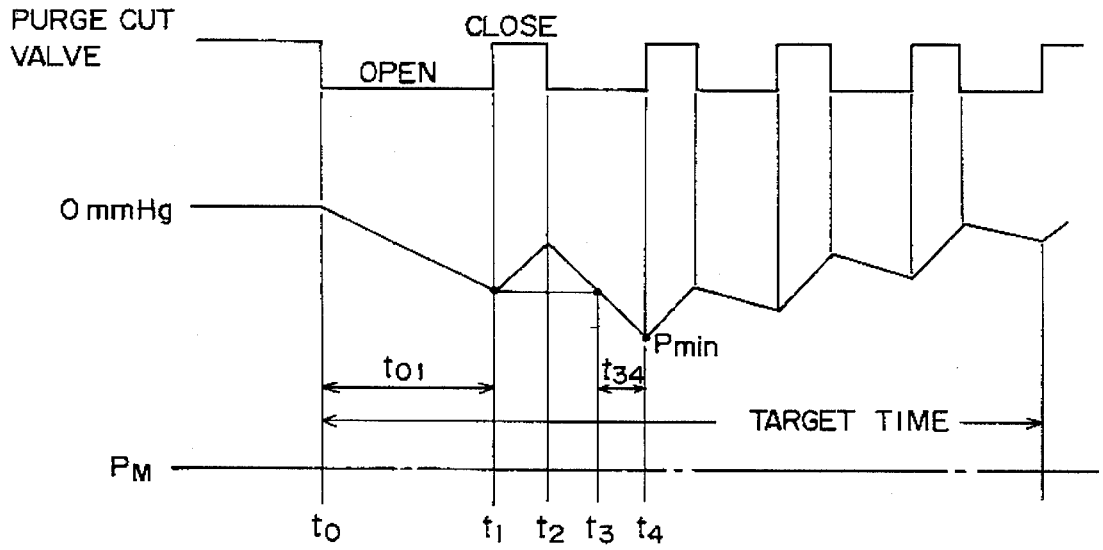
FIG. 16 is similar to FIG. 15, but showing another form of the pressure variation.

FIG. 16 shows the sampling pattern of the pull-down time $t_p$ when the target time is reached without the flowpath pressure P falling to the target pressure $P_M$. In this diagram, $t_{01}+t_{34}$ is sampled as the pull-down time $t_p$, and the minimum value $P_{min}$ of the flowpath pressure within the target time is stored in the parameter $P_P$.

Hence, even if a purge cut occurs during introduction of negative pressure, the process is resumed after the timer is stopped and held, so the time required to perform leak test by introducing negative pressure is shortened.

Figure 17:
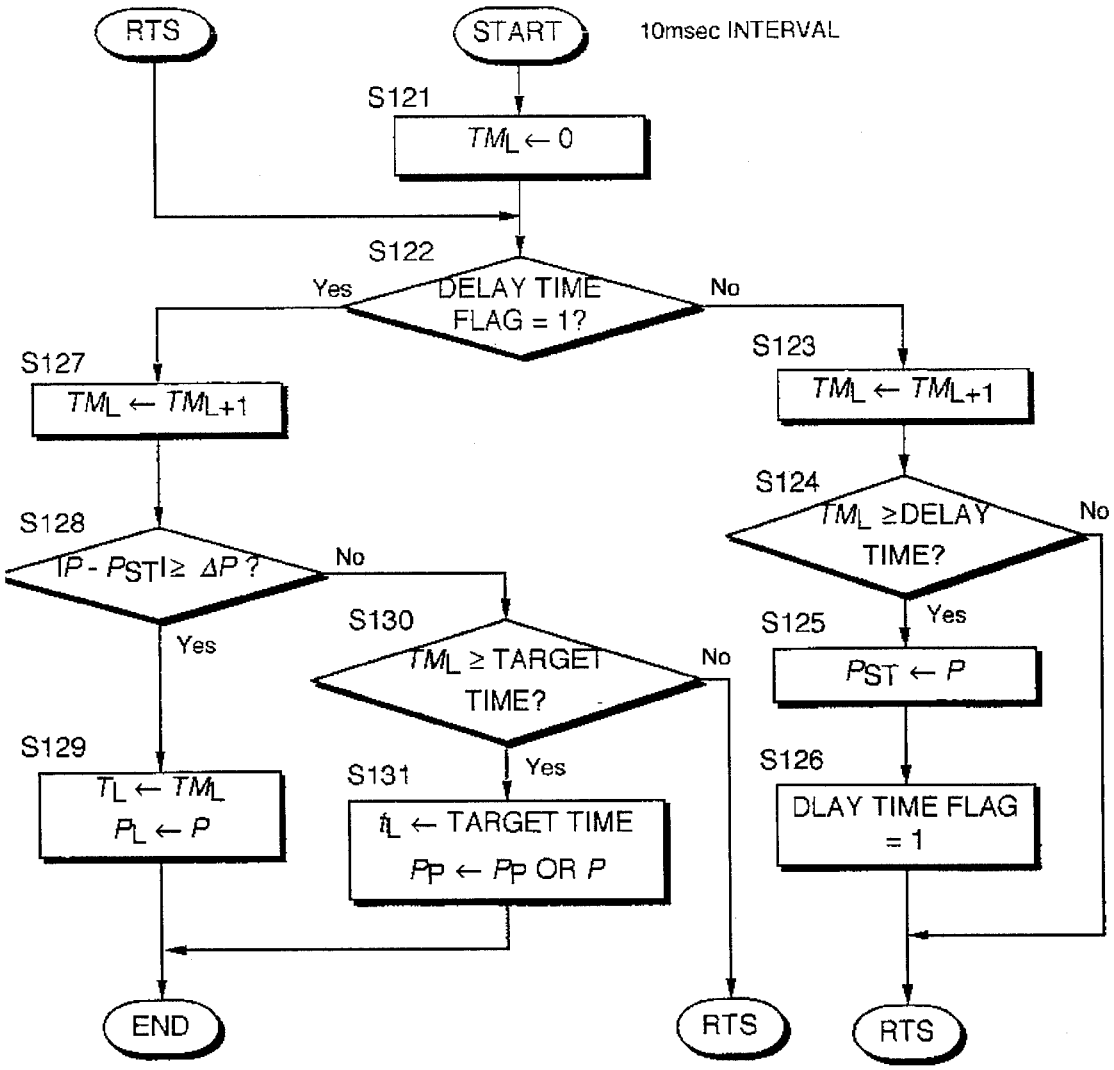
FIG. 17 is a flowchart showing a second half of the leak test process according to the second embodiment of this invention.

FIG. 17 is a flowchart for measuring the recovery time $t_L$ which may also be performed for example every 10 msec.

In a step S121, the timer value $TM_L$ is cleared and set to 0. The timer value $TM_L$ is provided in order to measure the recovery time $t_L$.

In a step S122, a delay time flag is examined. As this flag is initialized at "0", when the routine first advances to the step S122, the timer value $TM_L$ is incremented in a step S123. In a step S124, the timer value $TM_L$ and a set delay time (e.g. several seconds) are compared, and if $TM_L \geqq$the delay time, the flowpath pressure P at that time is entered in a parameter $P_{ST}$ in a step S125. In the step S125, the delay time flag is set to "1". The delay time is the time for pressure loss to stop after the gas flow stops following closure of the purge cut valve 9.

By setting the delay time flag to "1", in the next cycle, the process advances from the step S122 to the step S127. Here, the timer value $TM_L$ is incremented, and in a step S128. the absolute value $|P-P_{ST}|$ of the difference between the flowpath pressure P and the parameter $P_{ST}$, is compared with a predetermined value $\Delta P$ (e.g. +several mmHg).

If $|P-P_{ST}| \geqq \Delta P$, in a step S129, the timer value $TM_L$ is entered in the parameter $t_L$ expressing recovery time, the flowpath pressure P is entered in a parameter $P_L$, and the routine is terminated.

When $|P-P_{ST}| < \Delta P$, in a step S130, the timer value $TM_L$ and a target time (e.g. several minutes) are compared. If $TM_L \geqq$target time, in a step S131, the target time is then entered in the parameter $t_L$, the flowpath pressure P is entered in the parameter $P_L$, and the routine is terminated.

Next, a third embodiment of this invention will be described.

Figure 18:
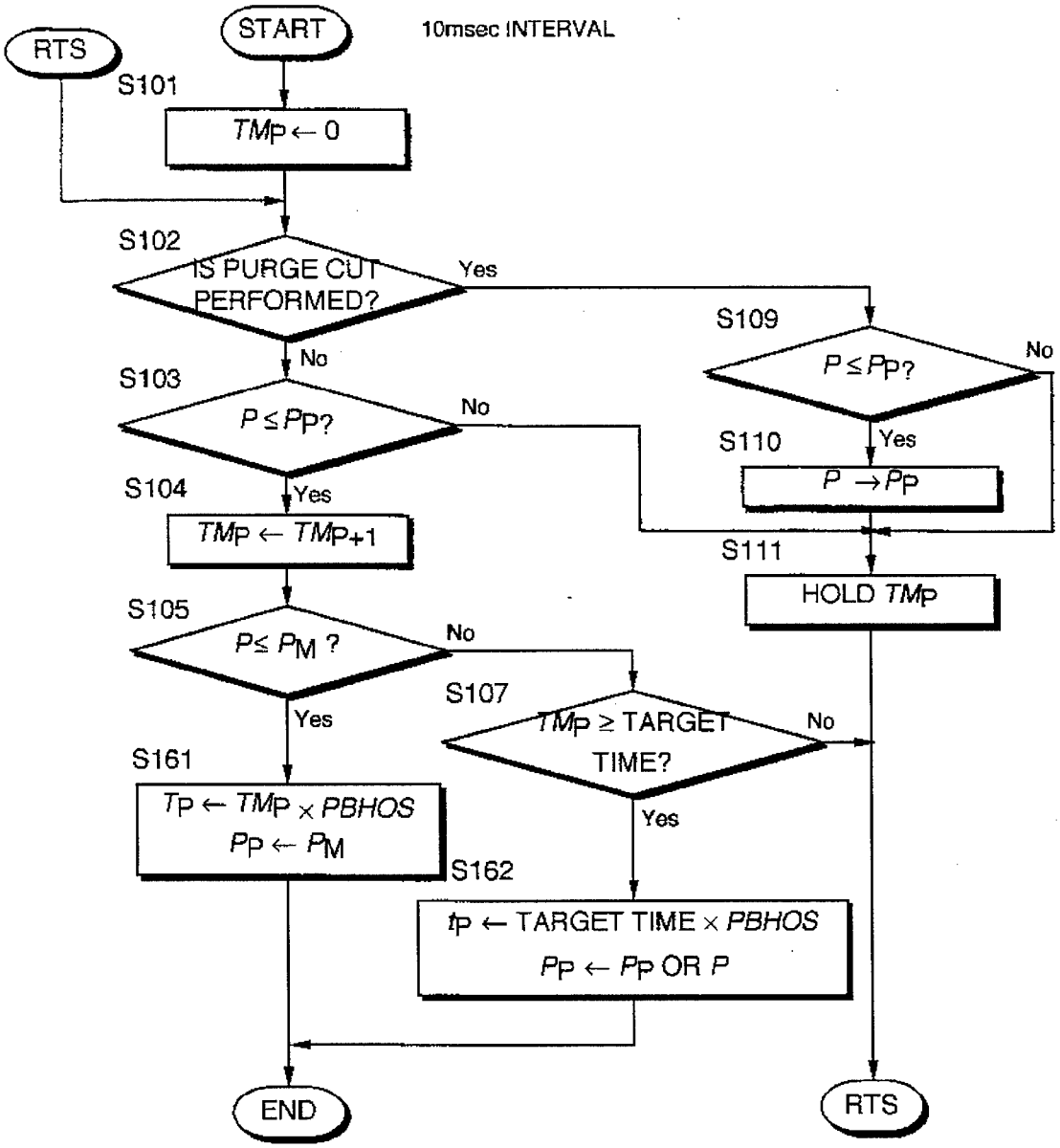
FIG. 18 is similar to FIG. 14, but showing a third embodiment of this invention.

As shown by steps S161, S162 in FIG. 18, the correction of the timer value $TM_P$ and target time entered in the parameter $t_p$ in the steps S106, S108 of the flowchart of FIG. 14, has an advantageous effect.

Figure 22:
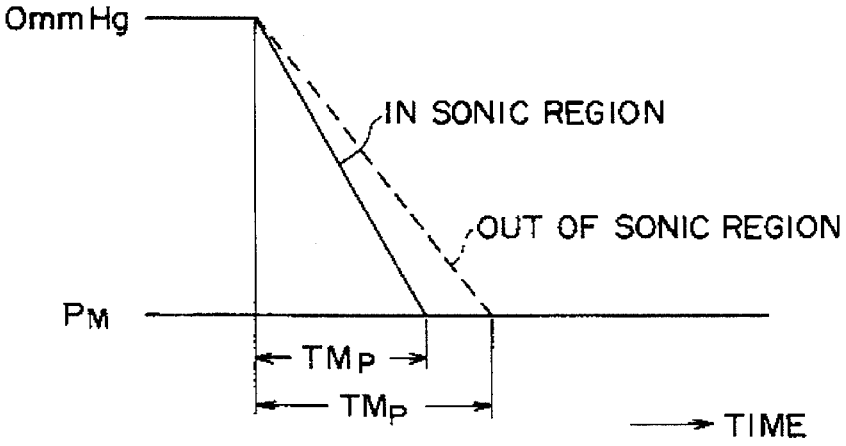
FIG. 22 is a diagram showing a change of a timer value $TM_P$ according to the third embodiment of this invention.

The aforesaid Equation 4 applies to the introduction of intake negative pressure in a sonic region where the flowrate is a sonic rate. For the flowrate to be a sonic rate, the intake negative pressure must be for example lower than −360 mmHg. If the accelerator pedal is depressed and the intake throttle 7 is opened wide while negative pressure is being introduced, the intake negative pressure becomes weaker and the flowrate shifts outside this region. In this case, the observed value of the pull-down time, i.e. the timer value $TM_P$, is longer than the value in the sonic region as shown in FIG. 22, so the leak hole surface area $AL_2$ is computed to be too large. The pressure correction coefficient PBHOS performs a correction for this; it reduces the timer value $TM_P$ or the target time outside the sonic region according to the difference between the flowrate at pull-down time and the flowrate in the sonic state.

Figure 19:
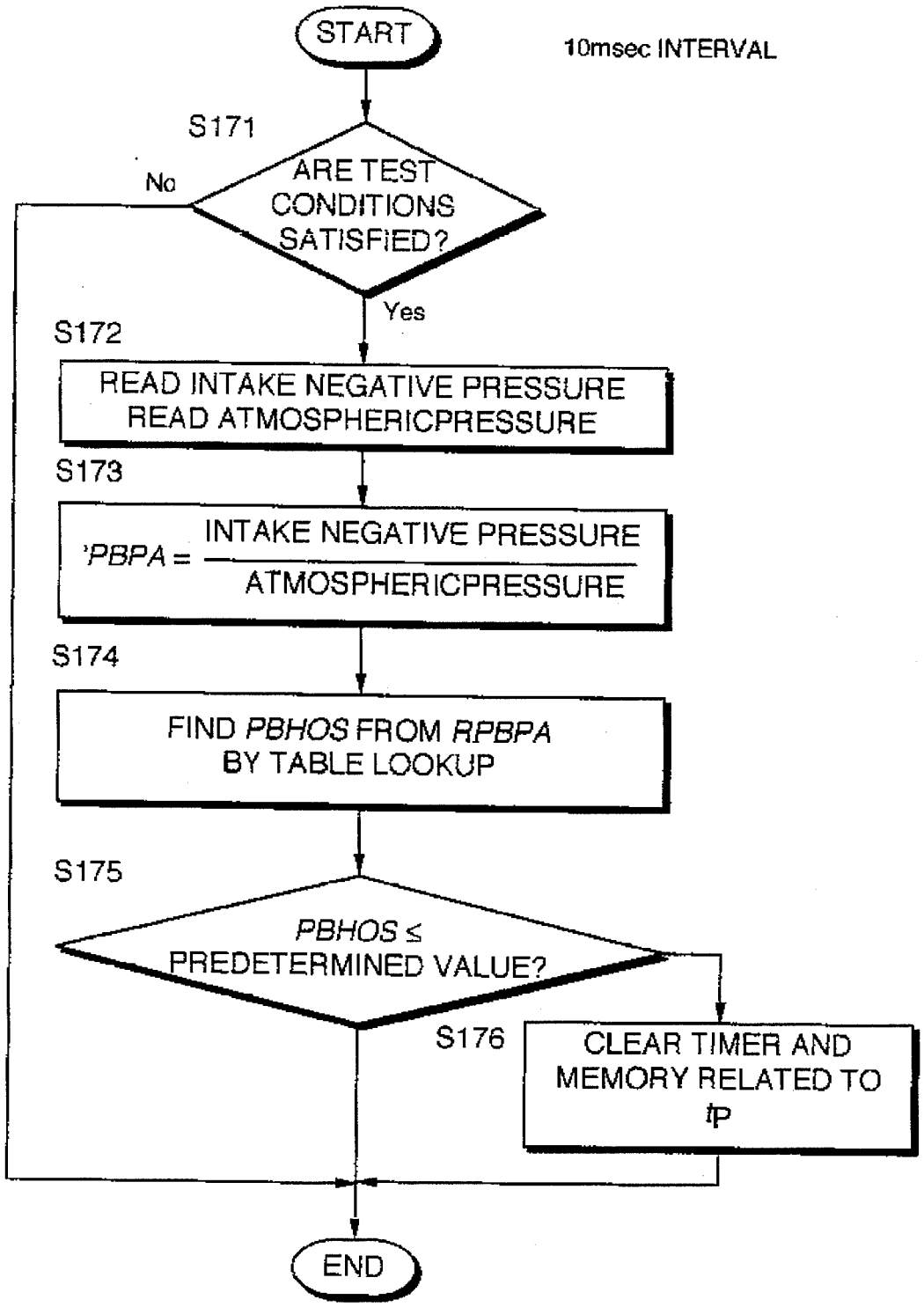
FIG. 19 is a flowchart showing a process for computing a pressure correction coefficient PBHOS according to the third embodiment of this invention.

FIG. 19 shows a process used to compute this pressure correction coefficient PBHOS. This process is executed at a fixed interval of for example 100 msec.

Figure 20:
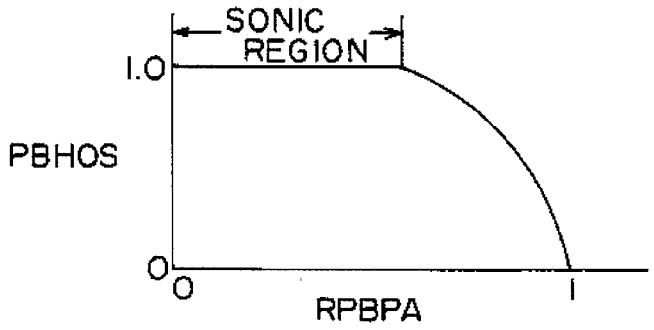
FIG. 20 is a graph showing characteristics of the pressure correction coefficient PBHOS.

In a step 171, it is determined whether or not the test conditions hold, and if they hold, in a step S172, the intake negative pressure and atmospheric pressure are read. In a step S173, a pressure ratio RPBPA is calculated as negative intake pressure/atmospheric pressure. In a step S174, the pressure correction coefficient PBHOS is found from this pressure ratio RPBPA by looking up a table based on FIG. 20. The pressure ratio RPBPA and flowrate ratio have the relation shown in FIG. 21, and FIG. 20 was constructed from these characteristics. The pressure sensor 13 outputs a voltage value [mV] according to a relative pressure based on atmospheric.

Outside the sonic region, the timer value $TM_P$ becomes larger than what it is in the sonic region, as shown by the dotted line in FIG. 22. The value of PBHOS is therefore set so that $TM_P$*PBHOS coincides with the value of $TM_P$ inside the sonic region.

Therefore, even if the flow inside the intake pipe drifts outside the sonic region due to depression of the accelerator pedal, etc., during pull-down, no error occurs in measuring the pull-down time, and the leak hole surface area $AL_2$ can be computed with high precision.

In a step S175 in FIG. 19, the pressure correction coefficient PBHOS is compared with a predetermined value (set to a very small value). If PBHOS≦predetermined value, it is determined that the intake throttle 7 is almost fully open, and in a step S176, the timer and memory used in measuring the pull-down time $t_p$ are cleared. This is done since, when the throttle is almost fully open and no intake negative pressure is effectively generated, large errors occur even if the pull-down time $t_p$ is measured. In this case, therefore, measurement of the pull-down time $t_p$ is not performed and is left for the next opportunity.

Figure 23:
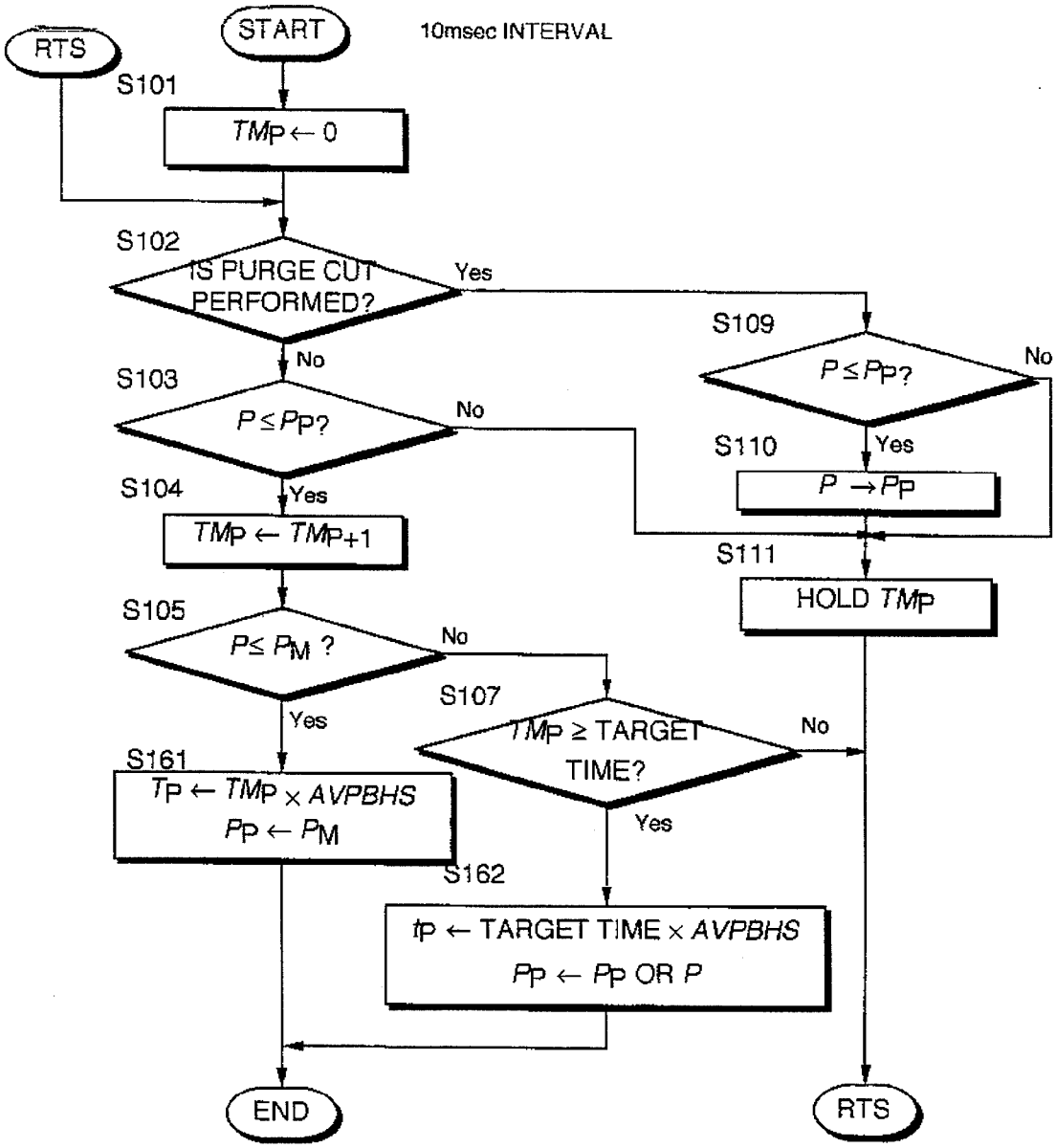
FIG. 23 is similar to FIG. 14, but showing a fourth embodiment of this invention.
Figure 24:
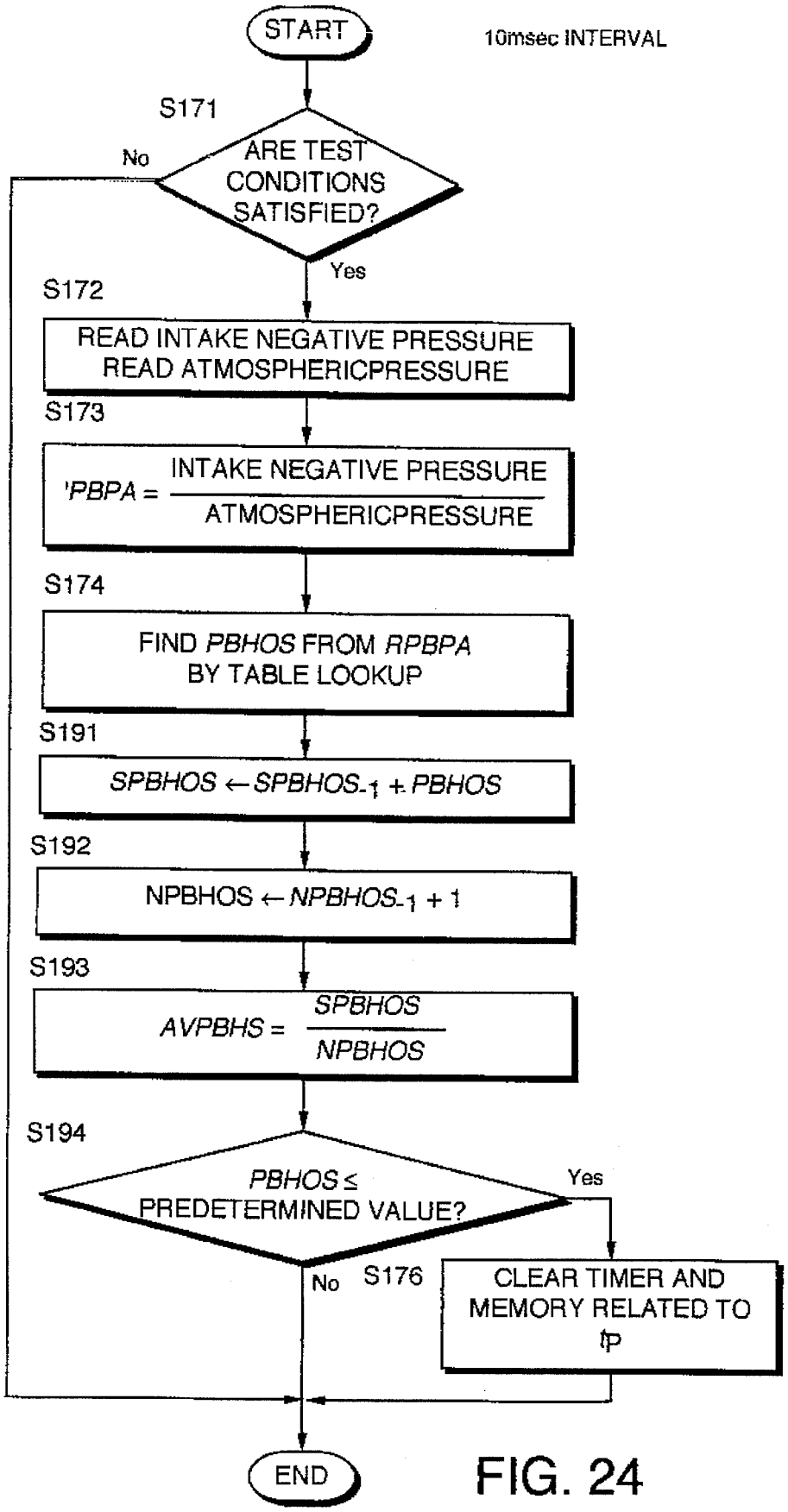
FIG. 24 is a flowchart showing a process of computing a cumulative average AVPBHS of the correction coefficient PBHOS according to the fourth embodiment of this invention.
Figure 25:
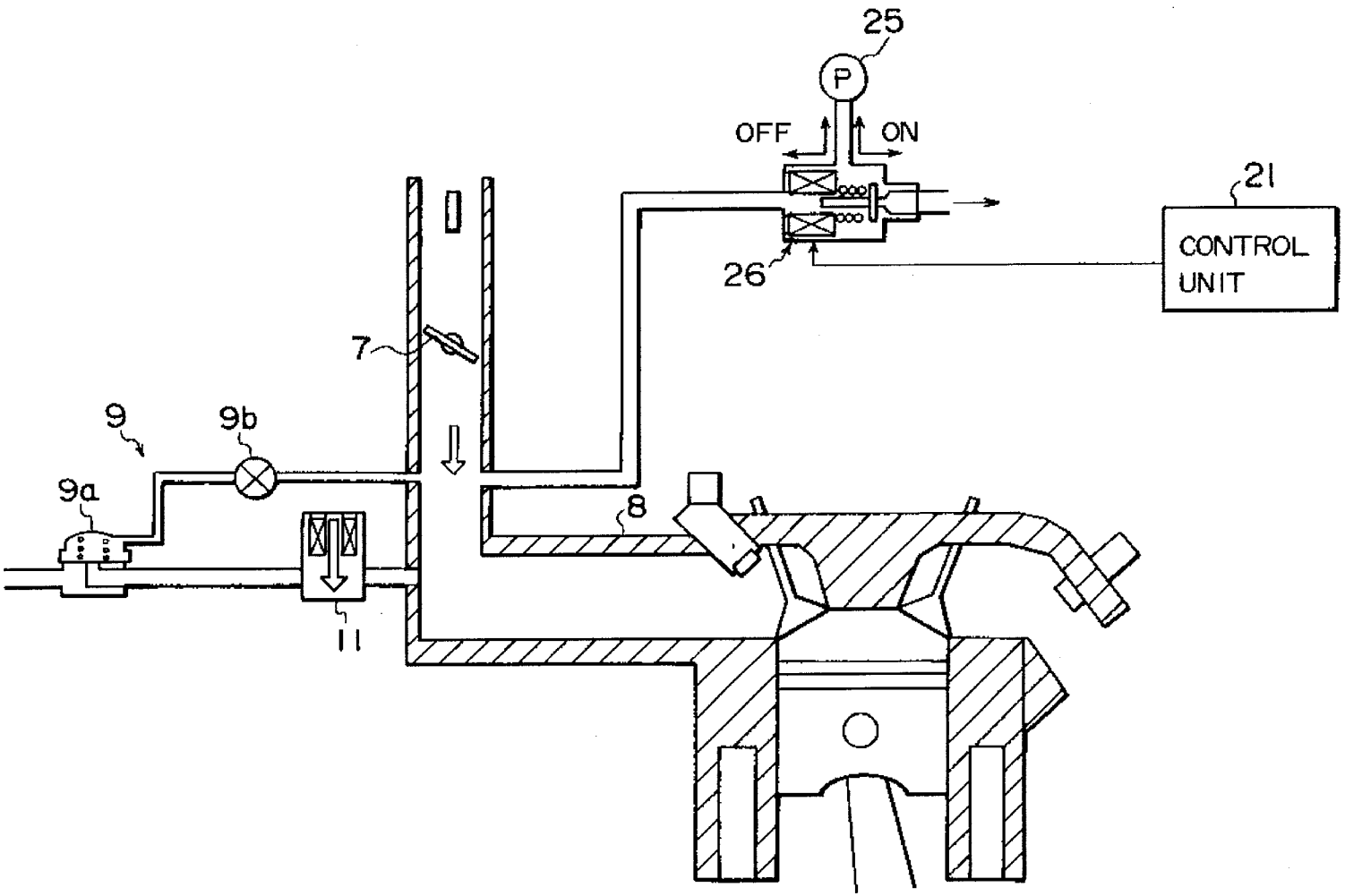
FIG. 25 is a schematic diagram showing a construction of a mechanism for detecting atmospheric pressure and intake negative pressure used in the third and fourth embodiments of this invention.

FIG. 23 and FIG. 24 show a fourth embodiment. These diagrams correspond to FIG. 18 and FIG. 19 of the third embodiment.

According to this embodiment, instead of the correction coefficient PBHOS, a cumulative average value AVPBHS of the correction coefficient PBHOS is used. Steps S181, S182 of FIG. 23 and S191 to S194 of FIG. 24, are different from the third embodiment.

In the step S191 of FIG. 23, a cumulative value SPBHOS of the correction coefficient PBHOS is calculated from the following equation:

$$SPBHOS=SPBHOS_{-1}+PBHOS \qquad \text{Equation 8}$$

where,

SPBHOS=current cumulative value $SPBHOS_{-1}$=SPBHOS on immediately preceding occasion.

In a step S192, a cumulative frequency NPBHOS is calculated from the following equation:

$$NPBHOS=NPBHOS_{-1}+1 \qquad \text{Equation 9}$$

where,

NPBHOS=current cumulative value $NPBHOS_{-1}$=NPBHOS on immediately preceding occasion.

In a step S193, a cumulative average value AVPBHS of the correction coefficient, is calculated by the following equation:

$$AVPBHS=\frac{SPBHOS}{NPBHOS} \qquad \text{Equation 10}$$

where, the initial values of SPBHOS and NPBHOS are 0.

By using the cumulative average AVPBHS of the correction coefficient PBHOS instead of the correction coefficient PBHOS itself, measurement of the download time $t_P$ is stable even if the flowrate alternates between the sonic region and other regions due to repeated depression and release of the accelerator pedal.

Figure 27:
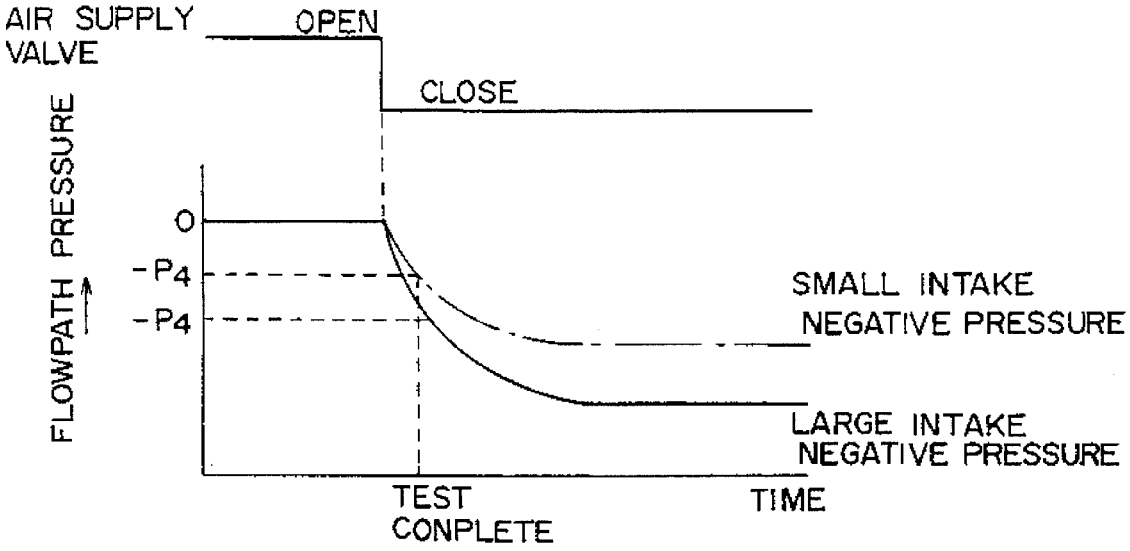
FIG. 27 is a graph showing the pressure variation in the flowpath during leak test according to the fifth embodiment of this invention.

FIG. 27 shows the structure of a mechanism used to read the atmospheric pressure and intake negative pressure in the step S172 of the third and fourth embodiments.

This mechanism consists of a pressure sensor 25 and solenoid valve 26. When the solenoid valve 26 is ON, atmospheric pressure is supplied to the pressure sensor 25, and when the solenoid valve is OFF, negative pressure downstream of the intake throttle 7 of the intake pipe 8 is supplied to the pressure sensor 25. Control of the solenoid valve 26 is performed by the control unit 21 according to the sequence below.

(1) When the following four conditions are all satisfied, the solenoid valve 26 is switched from OFF to ON and the atmospheric pressure is monitored.

(i) Atmospheric pressure monitor timer value INTPA≧Atomospheric pressure monitor interval INTPA#(e.g. 5–10 min)

As the atmospheric pressure is not so liable to fluctuation, it is sufficient to monitor it at fixed intervals.

The atmospheric pressure monitor timer value is incremented at fixed time intervals (e.g. 10 sec), and is cleared each time the atmospheric pressure is updated. Since INTPA is always cleared in this way, the atmospheric pressure cannot be measured on the first occasion unless INTPA is initially give a high value, therefore this is what is done.

(ii) There is no need to monitor intake negative pressure.

(iii) Intake throttle opening TVO<Upper limit ABCTVO#, and a time greater than a predetermined delay time DL YPA# has elapsed after the condition TVO<ABCTVO#.

(iv) Vehicle speed VSP<Upper limit PAVSPH#.

The reason for the conditions (iii) and (iv) is that, if the atmospheric pressure is monitored when TVO≧ABCTVO# or VSP≧PAVSPH#, errors arise in the measurement of atmospheric pressure due to the strong wind caused by the vehicle.

(2) If any of the following conditions hold, the solenoid 26 is switched OFF, and the intake negative pressure is monitored.

(i) It is required to measure the intake negative pressure. This measurement is required during the above pull-down time.

(ii) The atmospheric pressure was updated. This is to prevent erroneous results due to pressure changes when the vehicle is climbing a hill.

(iii) TVO≧ABCTVO#.

(iv) VSP≧PAVSPH#.

The solenoid 26 is OFF during initialization.

When this mechanism is used, cost is reduced as only one pressure sensor is required.

Returning to the step S15 of FIG. 8, if it is determined that there is a leak in the first flowpath section from the by-pass valve 14 to the purge cut valve 9, it may be desired to confirm the leak within this section.

Figure 26:
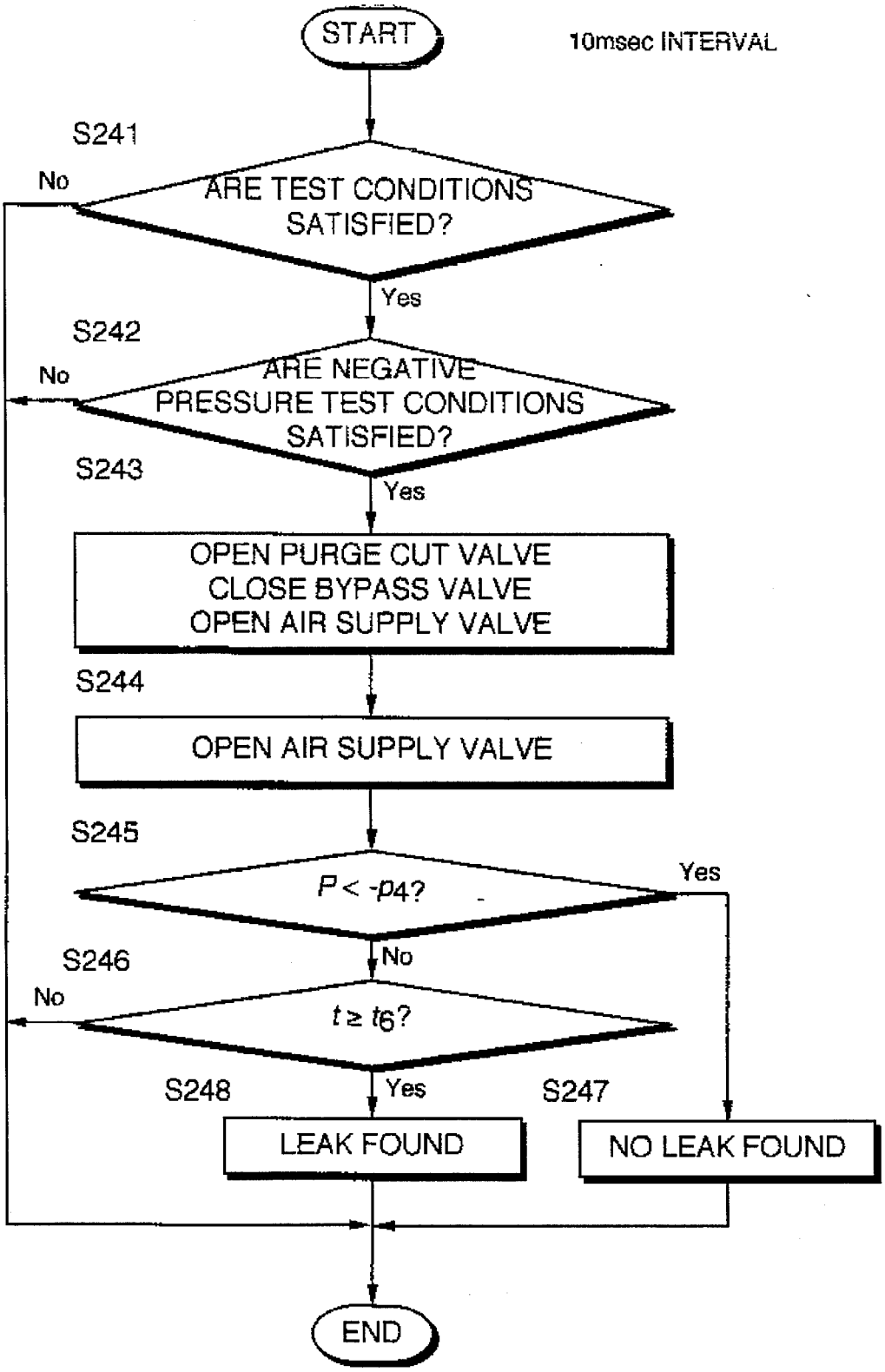
FIG. 26 is a flowchart showing a air supply valve leak test process according to a fifth embodiment of this invention.

FIG. 26 and FIG. 27 show a fifth embodiment of this invention concerning a leak test of the air supply valve 12.

Describing this embodiment referring to the flowchart of FIG. 26, first in a step S241, it is determined whether or not the conditions for starting a test, hold. The test conditions are that in a leak test performed with the first flowpath section from the aforesaid by-pass valve 14 to the purge cut valve 9, a leak has been found in this flowpath section, the pressure sensor 13 is functioning normally, and none of the by-pass valve 14 and purge cut valve 9, are defective.

If it is determined that there is no leak in the aforesaid test, a leak test is not performed on the air supply valve 12.

In a step S242, it is determined whether or not negative pressure test conditions hold. This is the same as the step S21 of the first embodiment.

When these test conditions hold, in a step S243 the purge cut valve 9 is opened, the by-pass valve 14 is closed, the air supply valve 12 is opened and purge is performed. The purge control valve 11 is opened to an opening that gives a predetermined flowrate (e.g. several liters/min).

In a step S244, the air supply valve 12 is closed during this purge, and a timer is started to measure the time t elapsed from when the air supply valve 12 was closed.

By closing the air supply valve 12, gas is aspirated at a predetermined flowrate, by intake negative pressure, toward the intake pipe 8 via the purge control valve 11 which functions as an orifice, and the pressure in the aforesaid first flowpath section falls.

In a step S245, the flowpath pressure P is compared with a predetermined value $-p_4$. If the flowpath pressure P has dropped below the predetermined value $-p_4$, it is judged in a step S247 that there is no leak.

In a step S246, if the flowpath pressure P does not fall below the predetermined value $-p_4$ although the time t that has elapsed from when the air supply valve 12 was closed exceeds the predetermined time $t_6$, it is notified in a step S248 that there is a leak in the air supply valve 12 by the lighting of a lamp or other means.

Hence, a leak test may be performed on the air supply valve 12 by observing the change of flowpath pressure P when the valve 12 is shut during purge while the by-pass valve 14 is closed. If this leak test is performed at about the same time as leak tests on the fuel tank 1 or other valves, the position of a leak can be precisely specified if a leak is detected.

The rate at which the flowpath pressure P falls after the purge cut valve 9 is closed following purge increases the larger is the negative intake pressure.

Figure 29:
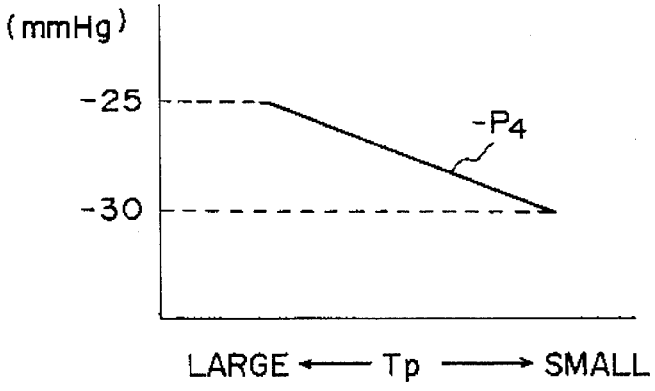
FIG. 29 is a graph showing contents of a map of the predetermined value $-P_4$ according to the sixth embodiment of this invention.
Figure 28:
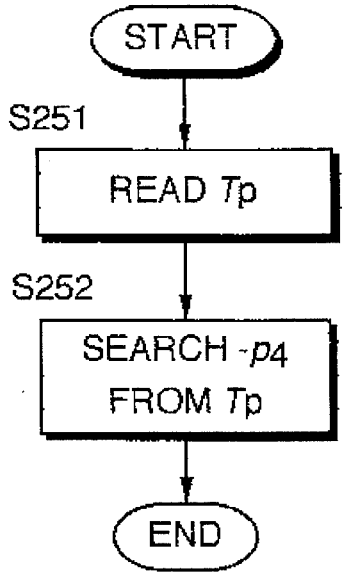
FIG. 28 is a flowchart showing a process of setting a predetermined value $-P_4$ according to a sixth embodiment of this invention.

According to the sixth embodiment of this invention shown in FIG. 28 and FIG. 29, in order to test for a leak in the air supply valve 12 at effectively fixed time intervals, the predetermined value $-p_4$ is made to vary so that it becomes larger the larger is the engine load.

In this case, as shown by the flowchart of FIG. 28, the control unit 21 reads a basic fuel injection amount in a step S251, and then searches the predetermined value $-p_4$ from a map shown in FIG. 29 based on the basic fuel injection amount Tp in a step S252.

The predetermined value $-p_4$ is preset according to experimental results such that it increases within the range from −10 mmHg to −20 mmHg as the basic fuel injection amount Tp increases.

Hence, by making the predetermined value $-p_4$ larger the larger is the intake negative pressure, differences in the rate of fall of the flowpath pressure P due to negative intake pressure are compensated, and as the time required to reach the predetermined value $-p_4$ is constant, the test precision is improved. Instead of the basic fuel injection amount Tp, the predetermined value $-p_4$ may also be set according to an engine load equivalent mount such as the intake air volume or the intake negative pressure in the intake pipe 8.

Figure 30:
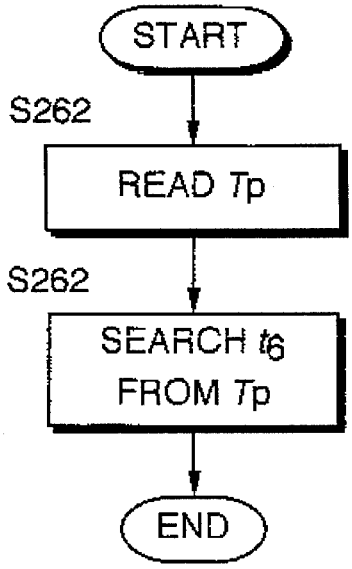
FIG. 30 is a flowchart showing a process of setting a predetermined time $t_6$ according to a seventh embodiment of this invention.
Figure 31:
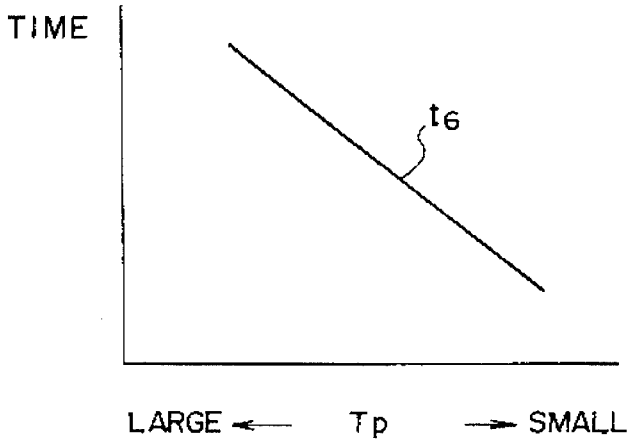
FIG. 31 is a graph showing contents of a map of the predetermined time $t_6$ according to the seventh embodiment of this invention.
Figure 32:
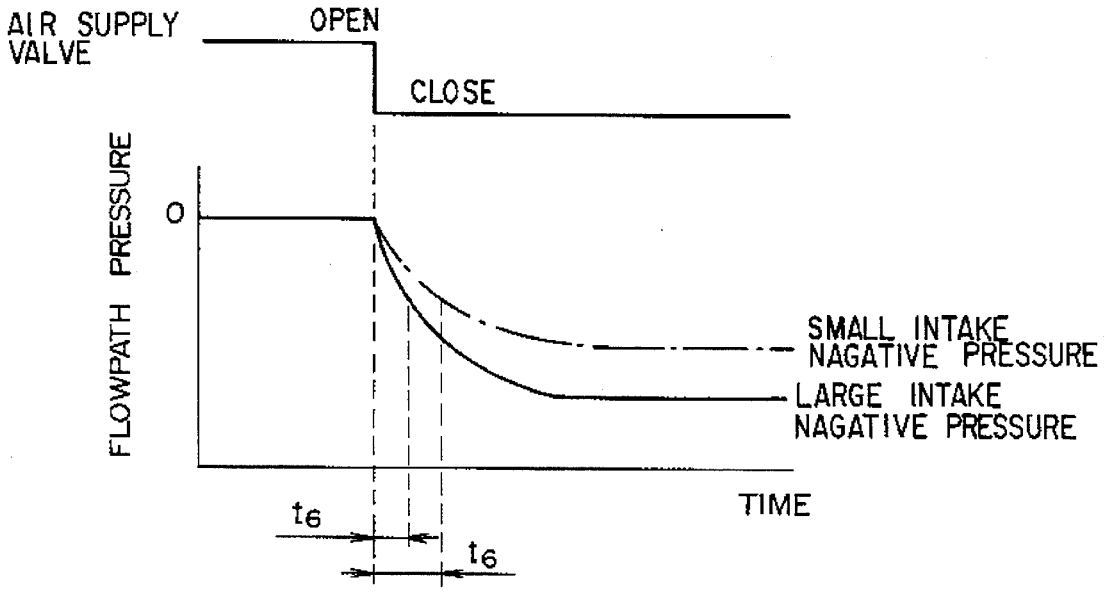
FIG. 32 is a graph showing the pressure variation in the flowpath during leak test according to the seventh embodiment of this invention.

According to the seventh embodiment of the invention shown in FIG. 30–FIG. 32, in order to complete the leak test earlier, the predetermined time $t_6$ is varied so that it is longer the higher is the engine load.

Figure 21:
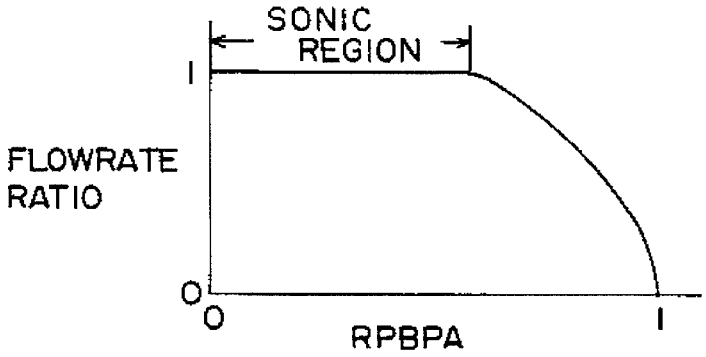
FIG. 21 is a graph showing a relation between a pressure ratio RPBPA and a flowrate ratio according to the third embodiment of this invention.

In this case, as shown by the flowchart of FIG. 21, the control unit 21 first reads a basic fuel injection amount Tp in a step S261, and then searches the predetermined time $t_6$ from a map in FIG. 31 based on the fuel injection amount Tp in the step S262.

The predetermined time $t_6$ is preset according to experimental results such that it becomes longer the more the basic fuel injection amount Tp increases.

Hence, by making the predetermined time $t_6$ shorter the larger is the intake negative pressure in the intake pipe 8, the time required to perform the leak test is shortened as shown in FIG. 32. Instead of the basic fuel injection amount Tp, the predetermined time $t_6$ may be set also according to am engine load equivalent amount such as the intake air volume or the intake negative pressure in the intake pipe 8.

If the by-pass valve 14 can no longer open or close according to its setting due to a fault, leak tests that depend on the opening and closing of this valve can no longer be performed.

Figure 33:
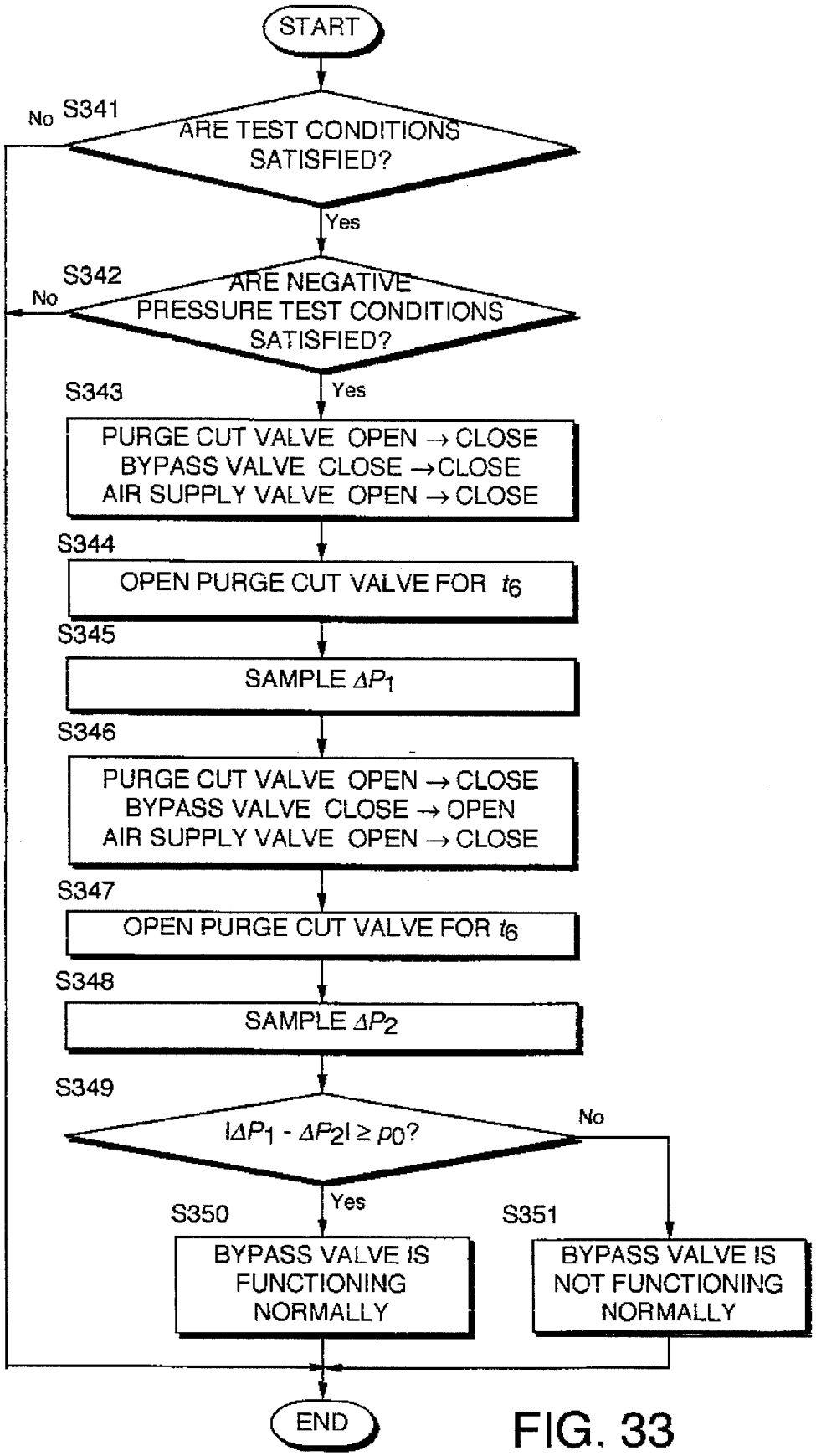
FIG. 33 is a flowchart showing a by-pass valve fault diagnosis process according to an eighth embodiment of this invention.
Figure 34:
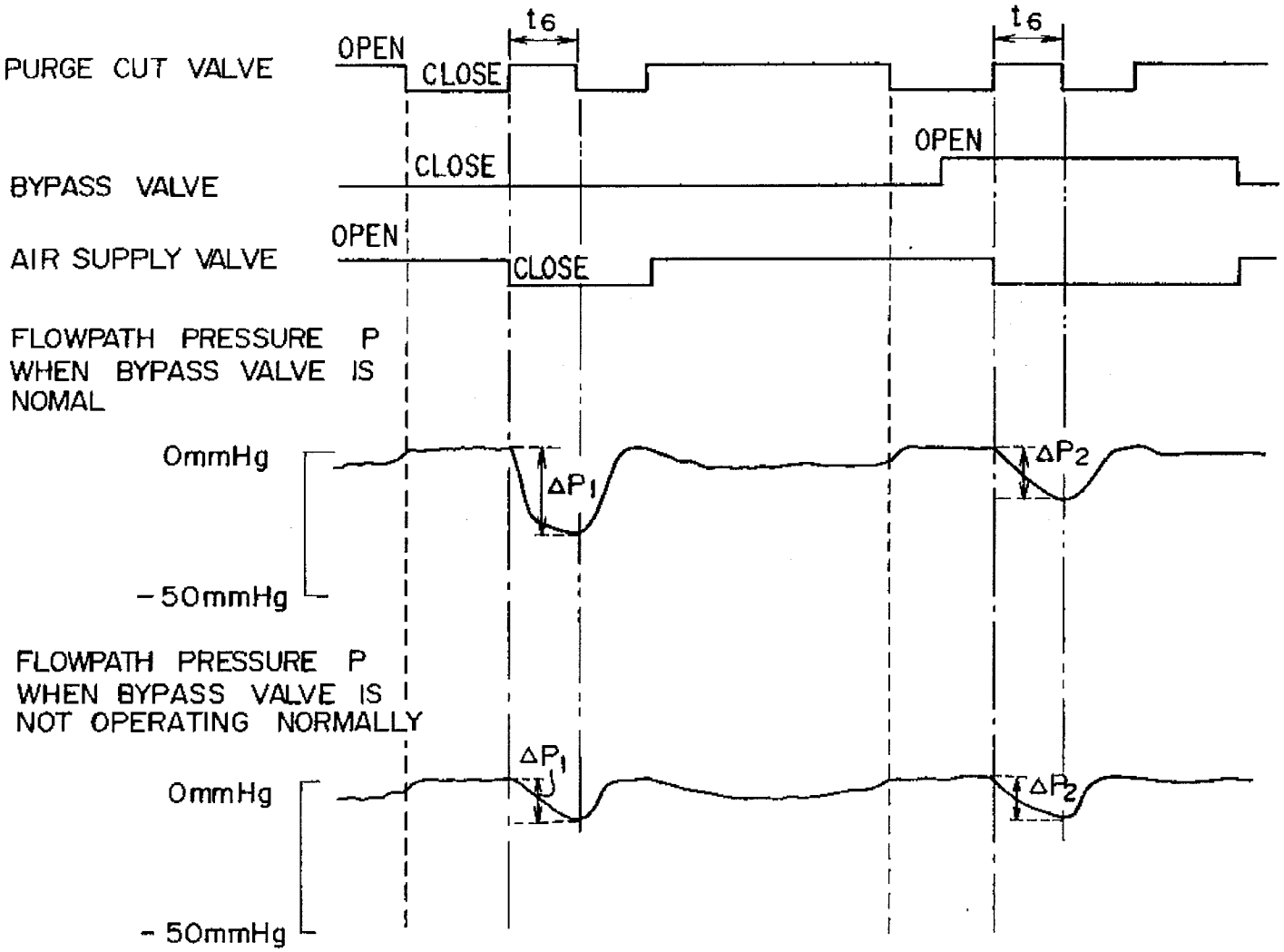
FIG. 34 is a diagram showing a variation of a detected pressure P according to the eighth embodiment of this invention.

FIG. 33 and FIG. 34 show an eighth embodiment of this invention related to a test for a fault in the by-pass valve 14.

Herein, the working state of the by-pass valve 14 is checked by comparing the variation characteristic of the flowpath pressure P immediately after opening the purge cut valve 9 when the by-pass valve 14 is closed, and the variation characteristic of the flowpath pressure P immediately after opening the purge cut valve 9 when the by-pass valve 14 is open.

The flowchart shown in FIG. 33 shows the process of testing the by-pass valve 14 executed by the control unit 21. FIG. 34 is a timing chart showing the control that is performed.

In a step S341, It is determined whether or not the conditions for starting test, hold. The test conditions are that a leak has been detected in the first flowpath section from the by-pass valve 14 to the purge cut valve 9 in the aforesaid first embodiment, that the pressure sensor 13 is functioning normally, and that there are no faults in valves such as the purge cut valve 9 and air supply valve 12.

If no leak was detected in the first flowpath section from the by-pass valve 14 to the purge cut valve 9, It is deemed that the by-pass valve 14 is functioning normally. In this case, therefore, a leak test is not performed on the by-pass valve 14 so that purge stop time is saved.

In the step S343, it is determined whether or not intake negative pressure conditions hold. This is the same as the step S21 of the aforesaid first embodiment.

When the aforesaid test conditions are satisfied, in a step S343, the purge cut valve and air supply valve 12 are both opened, and after shifting to the purge state with the by-pass valve 14 closed, the purge cut valve 9 and air supply valve 12 are closed. This seals the first flowpath section from the by-pass valve 14 to the purge cut valve 9. The flowpath from the by-pass valve 14 to the purge cut valve 9 is then effectively at atmospheric pressure.

In a step S344, the purge cut valve 9 is opened for the predetermined time $t_6$ (e.g. 10 sec) from this sealed state. When the purge cut valve 9 is open, the flowpath pressure P is sampled and stored. At this time, the purge control valve 11 is opened to an opening that gives a predetermined flowrate (e.g. several liters/min).

In a step S345, the difference between the minimum value of the flowpath pressure P during the predetermined time $t_6$ from when the purge cut valve 9 is opened and the sampling value in the step S344, is sampled as $\Delta P_1$.

In a step S346, the system is temporarily returned to the purge state as in the step S343. the purge cut valve 9 and air supply valve 12 are closed, and the by-pass valve 14 is opened. This seals the second flowpath section from the fuel tank 1 to the purge cut valve 9. The flowpath from the fuel tank 1 to the purge cut valve 9 is then effectively at atmospheric pressure.

In a step S347, the purge cut valve 9 is opened from this sealed state for a predetermined time $t_6$. The flowpath pressure P is sampled and stored when the purge cut valve 9 is opened.

In a step S348, the difference between the minimum value of the flowpath pressure P during the predetermined time $t_6$ from when the purge cut valve 9 is opened and the sampling value in the step S347, is sampled as $\Delta P_2$.

In a step S349, $|\Delta P_1-\Delta P_2|$ is compared with a predetermined value $p_0$.

If it is determined that $|\Delta P_1-\Delta P_2|$ is equal to or greater than the predetermined value $p_0$, it is deemed in a step S350 that the by-pass valve 14 is functioning normally.

If is determined that $|\Delta P_1-\Delta P_2|$ is less than the predetermined value $p_0$, it is deemed in a step S351 that the by-pass valve 14 is not functioning normally, and a lamp indicating this fact is lit.

When the by-pass valve 14 is closed, the first flowpath section between the by-pass valve 14 and the purge cut valve 9 is a sealed section. As this section does not contain the fuel tank 1, its capacity is small, so when the purge cut valve 9 is opened and intake negative pressure is led to the flowpath, the flowpath pressure P drops rapidly.

On the other hand, when the by-pass valve 14 is open, the second flowpath section between the fuel tank 1 and purge cut valve 9 is a sealed section. As this section contains the fuel tank 1, its capacity is large, so when the purge cut valve 9 is opened and intake negative pressure is led to the flowpath, the flowpath pressure P drops gradually.

Therefore, when the by-pass valve 14 is functioning normally and the vapor passage 2 is completely closed as shown in FIG. 34, $|\Delta P_1-\Delta P_2|$ will be greater than the predetermined value $p_0$ On the other hand, when the by-pass valve 14 has a fault and the vapor passage 2 cannot be completely closed off, $|\Delta P_1-\Delta P_2|$ will be smaller than the predetermined value $p_0$.

By performing this fault test on the by-pass valve 14 in conjunction with leak tests on the fuel tank 1 and the other valves, the position of a leak can be specified.

Figure 35:
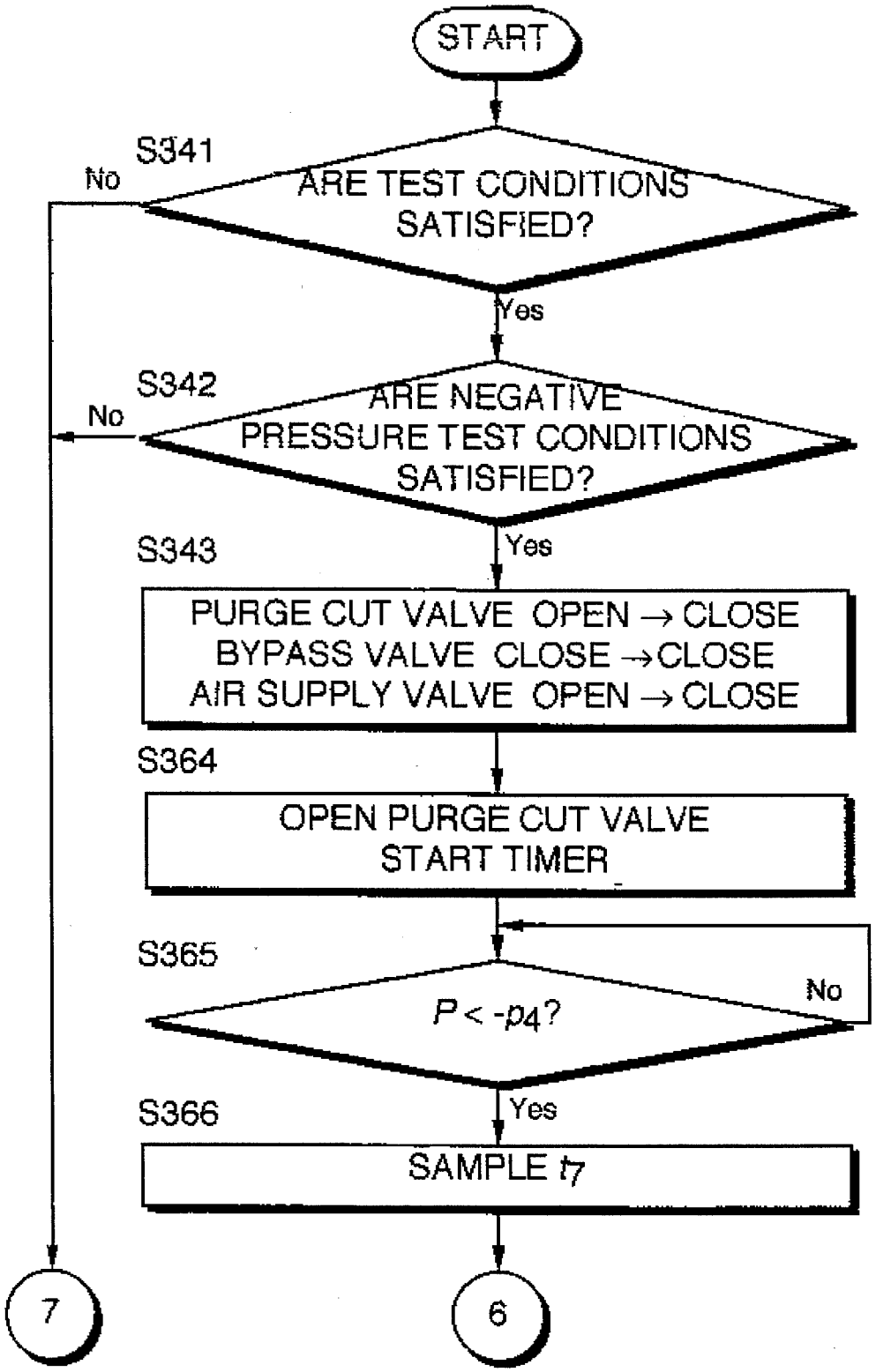
FIG. 35 is a flowchart showing a first half of a by-pass valve fault diagnosis process according to a ninth embodiment of this invention.
Figure 36:
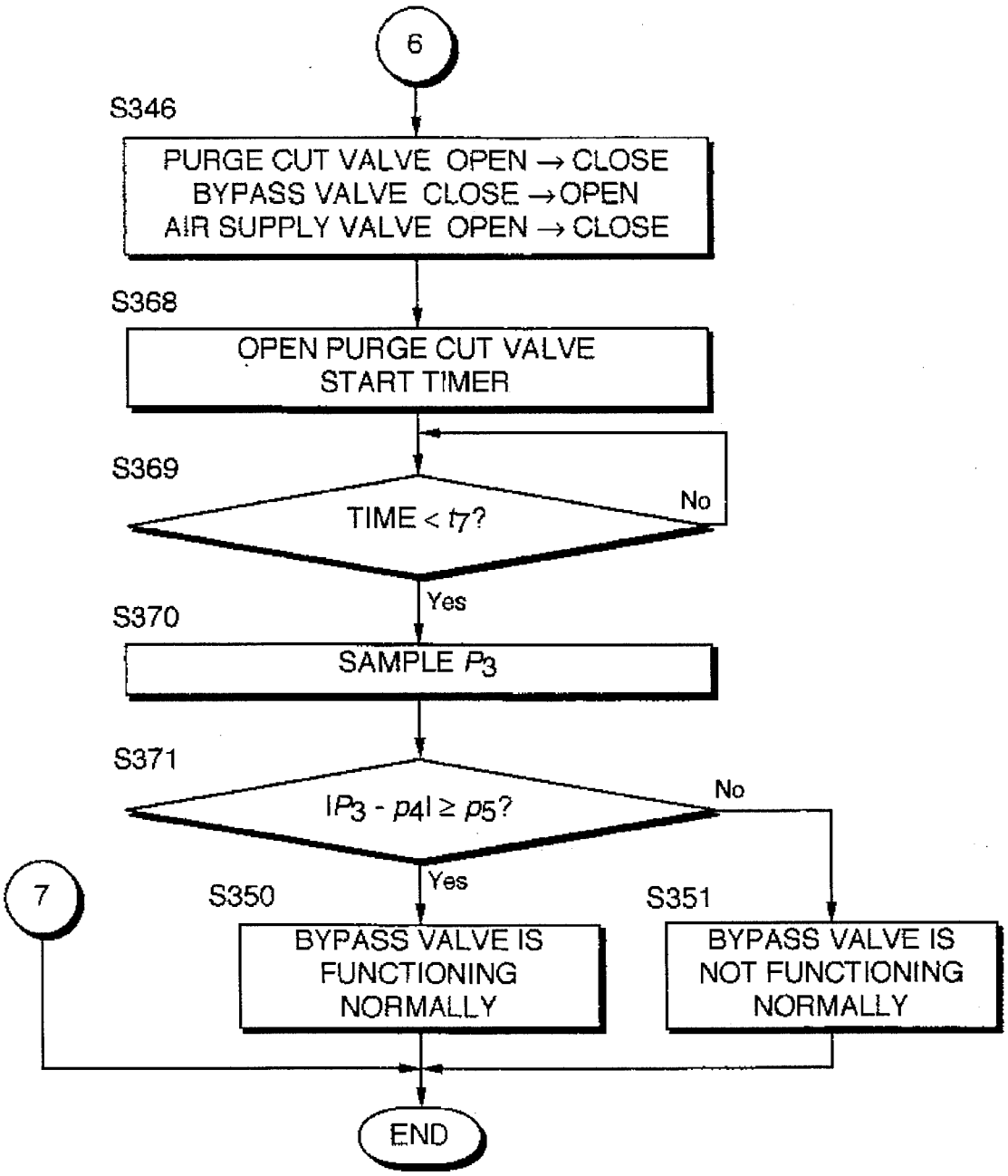
FIG. 36 is a flowchart showing a second half of the by-pass valve fault diagnosis process according to the ninth embodiment of this invention.
Figure 37:
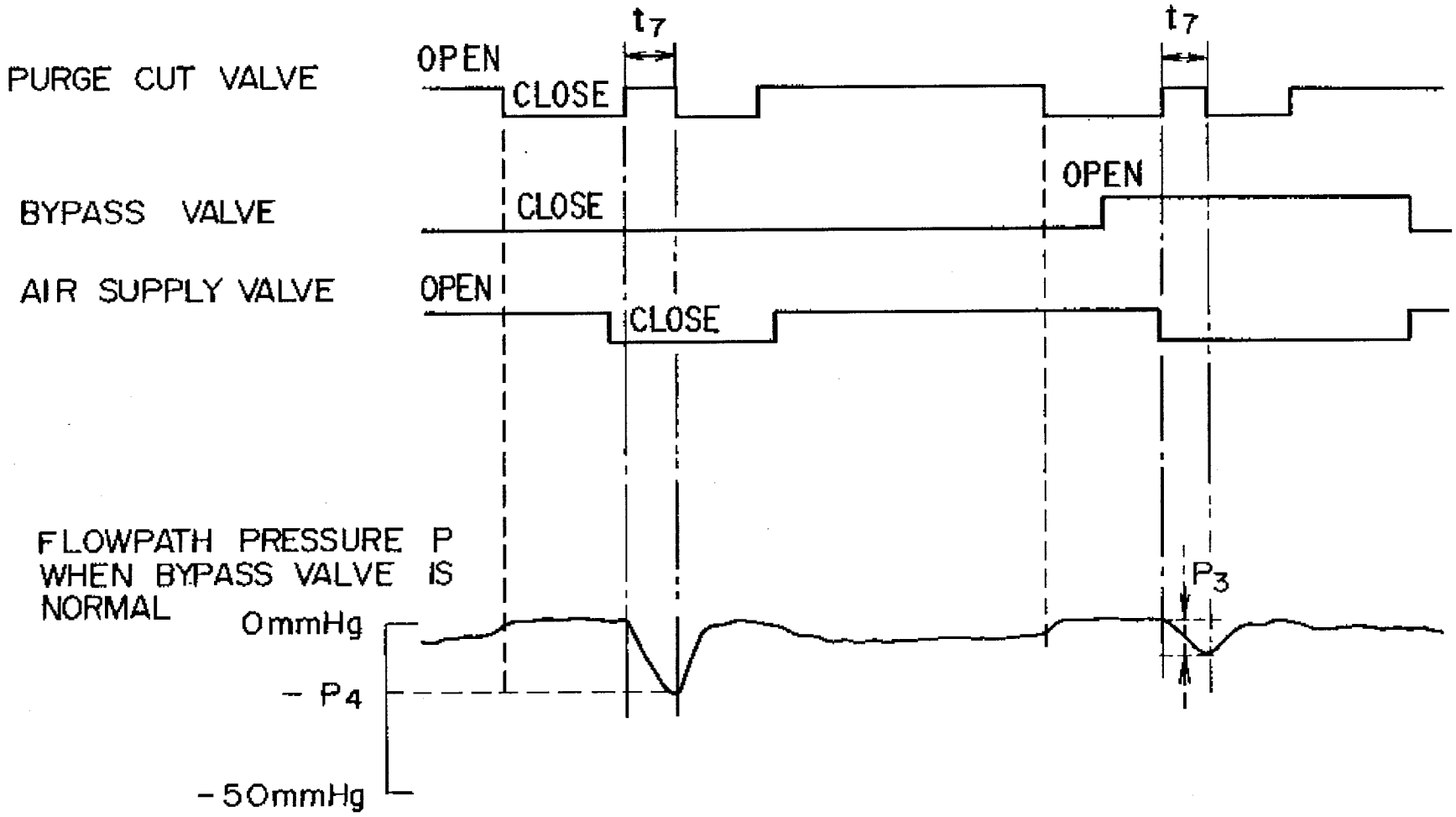
FIG. 37 is a diagram showing a variation of the detected pressure P according to the ninth embodiment of this invention.

FIGS. 35–37 show a ninth embodiment of this invention.

According to this embodiment, the time $t_7$ taken for the flowpath pressure P after the purge cut valve 9 is opened when the flowpath was sealed with the by-pass valve 14 closed, to reach the predetermined value $-p_4$, is measured. A flowpath pressure $P_3$ after the purge cut valve 9 is opened for the same time $t_7$ when the flowpath was sealed with the by-pass valve 14 open, is read. This flowpath pressure $P_3$ is compared with a predetermined value $p_5$ so as to determine whether or not there is a fault in the by-pass valve 14.

The flowcharts of FIG. 36 and FIG. 37 show a process for testing for a fault in the by-pass valve 14 executed by the control unit 21. FIG. 34 is a timing chart that shows details of the control that is performed.

From steps S341 to S343, the process is the same as that of the eighth embodiment.

In a step S364, the purge cut valve 9 is opened from the sealed state, and the time from when the purge cut valve 9 is opened is counted. At this time, the purge control valve 11 is opened to an opening that gives a predetermined flowrate (e.g. several liter/min).

In a step S365, it is determined whether or not the flowrate pressure P has dropped below the predetermined value $-p_4$ (−20 mmHg).

In the step S366, the time when the flowpath pressure P dropped below the predetermined value $-p_4$ is sampled as $t_7$.

In the step S346, as In the aforesaid eighth embodiment, the second flowpath section from the fuel tank 1 to the purge cut valve 9 is sealed.

In a step S368, the purge cut valve 9 is opened, and the time from when the purge cut valve 9 was opened is measured.

In a step S369, if it is determined that the time from when the purge cut valve was opened exceeds the aforesaid measurement time $t_7$, the flowpath pressure P at that time is sampled as $P_3$ in the step S369.

In a step S371, $|P_3-p_4|$ based on this sampling value $P_3$ is compared with a predetermined value $p_5$.

If it is determined that $|P_3-p_4|$ is equal to or greater than the predetermined value $p_5$, it is deemed in a step S350 that the by-pass valve 14 is functioning normally.

This is due to the fact that when the by-pass valve 14 is functioning normally and the vapor passage 2 is completely closed, the pressure drops rapidly so that $|P_3-p_4|$ is equal to or exceeds the predetermined value $p_5$.

If it is determined that $|P_3-p_4|$ is less than the predetermined value $p_5$, it is deemed that the operation of the by-pass valve 14 is faulty in a step S351, and a lamp indicating this is lit.

This is due to the fact that when the by-pass valve 14 has a fault so that the vapor passage 2 cannot be completely closed, as the capacity of the sealed flowpath contains the fuel tank 1, the pressure drops slowly so that $|P_3-p_4|$ will be less than $p_5$.

According to this embodiment, when the time $t_7$ for which the purge cut valve 9 is open in the step S366 is, for example, 5 seconds, the purge cut valve 9 is opened again for the same time from the step, S368 onwards, so the total time for which the purge cut valve 9 is open is $t_7+t_7=10$ seconds.

According to the aforesaid eighth embodiment, the time for which the purge cut valve 9 was open was fixed at, for example, 10 seconds, so the total time in this case is $t_6+t_6=20$ seconds. In other words, the time for which the purge cut valve 9 is open is not fixed, but is determined for each test based on the negative pressure conditions. This allows considerable reduction of the test time.

In the aforesaid embodiments, the by-pass valve 14 was provided in a passage that by-passes the pressure control valve 3. However, in a leak test apparatus using positive pressure, the pressure control valve 3 is not essential. For example, instead of the pressure control valve 3, a valve that opens and closes the vapor passage 2 upon a signal from the control unit 21 may be provided.

Further, according to the aforesaid embodiments, the purge cut valve 9 and purge control valve 11 were provided as separate units, however the purge control valve 11 may also be given the functions of the purge cut valve 9. It is moreover possible to make the purge cut valve 9 a solenoid valve that opens and closes upon a signal from the control unit 21.

The embodiments of this invention in which an exclusive property or privilege is claimed are defined as follows:

1. A leak test system for a vaporized fuel treatment mechanism comprising:

a fuel tank for supplying fuel to an engine mounted in an automobile, an intake pipe for aspirating air for combustion in said engine, a throttle provided in said intake pipe for regulating an amount of said air, a canister for adsorbing vaporized fuel, a first passage for leading vaporized fuel from said fuel tank to said canister, a first valve for opening and closing said first passage, a second passage connecting said canister with said intake pipe downstream of said throttle, a second valve for opening and closing said second passage, a third valve for introducing fresh air into said canister, means for detecting pressure in a first flowpath section from said first valve to said second valve via said canister, first determining means for determining whether or not an engine running condition satisfies a predetermined positive pressure test condition, first operating means for closing said second and third valves while opening said first valve, and second determining means for determining a presence or absence of a leak based on a variation of the pressure according to an operation of said first operating means.

2. A leak test system as defined in claim 1, wherein said second determining means determines that said fuel tank has no leak when the pressure is equal to or greater than said predetermined value after the operation of said first operating means.

3. A leak test system as defined in claim 1, wherein said second determining means comprises means for sampling said pressure as a first pressure when the pressure is equal to or greater than a predetermined value after the operation of said first operating means, second operating means for closing said first valve after said sampling, a first timer for measuring a time elapsed from an operation of said second operating means, means for sampling the pressure in said first flowpath section as a second pressure when the time measured by said first timer has reached a predetermined value, and third determining means for determining whether or not there is a leak in said first flowpath section based on said first and second pressures.

4. A leak test system as defined in claim 3, further comprising third operating means for opening said first and second valves and closing said third valve when said pressure in said first flowpath section after the operation of said first operating means is less than said predetermined value, and fourth determining means for determining whether or not there is a leak in said second flowpath section from said second valve to said fuel tank via said canister, using negative pressure introduced by am operation of said third operating means.

5. A leak test system as defined in claim 4, further comprising fifth determining means for determining whether or not a test condition is suitable for testing by negative pressure, means for repeating a determining process by said second determining means when the time measured by said first timer has reached a predetermined value and said fifth determining means determines that the condition is not suitable for testing by negative pressure.

6. A leak test system as defined in claim 4, wherein said fourth determining means comprises a second timer for measuring a time elapsed after the operation of said third operating means, means for sampling the time measured by said second timer as a pull-down time when a pressure differential between a pressure in said second flowpath section and an initial pressure has reached a predetermined value, a fourth operating means for closing said second valve in synchronism with the sampling of said pull-down time, a third timer for measuring a time elapsed from operation of said fourth operating means, means for sampling the pressure differential between the pressure in said second flowpath section and said initial pressure as a third pressure when a predetermined time has elapsed after operation of said fourth operating means, means for sampling the pressure differential between the pressure in said second flowpath section and said initial pressure as a fourth pressure when the difference between the pressure in said second flowpath section and said third pressure has reached a predetermined value, means for sampling the time measured by said third timer as a recovery time when said fourth pressure is sampled, means for computing a leak hole surface area in said second flowpath section based on said third pressure, said fourth pressure, said pull-down time and said recovery time, and sixth determining means for determining whether or not there is a leak in said second flowpath section by comparing said leak hole surface area with a predetermined value.

7. A leak test system as defined in claim 1, wherein said first determining means comprises means for detecting a pressure in a third flowpath section between said first valve and said fuel tank, and seventh determining means for determining that the positive pressure test condition holds when the pressure in said third flowpath section is equal to or greater than a predetermined value while said first valve is closed.

8. A leak test system as defined in claim 1, wherein said system further comprises means for starting said engine while said first valve remains closed, and said first determining means comprises means for detecting a fuel temperature in said fuel tank and eighth determining means for determining that the positive pressure test condition holds when a rise of fuel temperature after said engine is started has reached a predetermined value $\Delta T_1$.

9. A leak test system as defined in claim 8, wherein said predetermined value $\Delta T_1$ is set larger the lower is the fuel temperature when the engine is started.

10. A leak test system as defined in claim 1, wherein said system further comprises means for starting said engine while said first valve remains closed, and said first determining means comprises ninth determining means for determining that the positive pressure test condition holds when a time elapsed after starting said engine has reached a predetermined value TMEVD.

11. A leak test system as defined in claim 10, wherein said predetermined value TMEVD is set larger the lower is the fuel temperature when the engine is started.

12. A leak test system as defined in claim 1, further comprises a fourth valve in parallel with said first valve, said forth valve closing when a positive pressure in said fuel tank is less than a predetermined value and opening when said positive pressure is greater than a predetermined value.

13. A leak test system as defined in claim 6, wherein said system further comprises a tenth determining means for determining whether or not the engine running condition satisfies a predetermined negative pressure test condition, and fifth operating means for closing said second valve when said negative pressure condition does not hold after the operation of said third operating means and for opening said second valve when the negative pressure test condition has been restored, and said second timer interrupts time measurement according to an operation of said fifth operating means.

14. A leak test system as defined in claim 7, wherein said system further comprises means for retaining a pressure in said second flowpath section when said second valve is closed by said fifth operating means, and eleventh determining means for determining whether or not said second flowpath pressure has become equal to said retained pressure after said second valve has been re-opened by said fifth operating means, and said second timer interrupts time measurement from when said second valve is closed to when the determined result of said eleventh determining means becomes affirmative.

15. A leak test system as defined in claim 6, further comprising means for detecting an atmospheric pressure, means for detecting an intake negative pressure in said intake pipe, means for computing a pressure ratio of said atmospheric pressure to said intake negative pressure, twelfth determining means for determining whether or not said pressure ratio is within a sonic region, and means for reducing said pull-down time when said ratio is outside said sonic region.

16. A leak test system as defined in claim 15, wherein said reducing means comprises means for computing a correction coefficient based on said pressure ratio, said correction coefficient becoming smaller as said pressure ratio approaches 1, and means for correcting said pull-down time by said correction coefficient.

17. A leak test system as defined in claim 15, wherein said reducing means comprises means for computing a correction coefficient based on said pressure ratio, said correction coefficient becoming smaller as said pressure ratio approaches 1, means for computing a cumulative average of said correction coefficient, and means for correcting said pull-down time by said cumulative average.

18. A leak test system as deemed in claim 16, wherein said second timer interrupts time measurement when said correction coefficient is equal to or less than a predetermined value.

19. A leak test system as defined in claim 15, wherein said atmospheric pressure detecting means and said intake negative pressure detecting means comprises a pressure sensor, said sensor comprising means for selectively supplying atmospheric pressure or intake negative pressure to said sensor.

20. A leak test system as defined in claim 19, wherein said means for selectively supplying pressure does not supply atmospheric pressure to said pressure sensor when a wind caused by the automobile is strong.

21. A leak test system as defined in claim 3, further comprising thirteenth determining means for determining whether or not a predetermined negative pressure test condition holds when there is a leak in said first flowpath section, sixth operating means for closing said first valve and opening said second and third valves when said negative pressure test condition holds, seventh operating means for closing said third valve after an operation of said sixth operating means, and fourteenth determining means for determining whether or not there is a leak in said third valve based on a pressure change in said first flowpath section after closing said third valve.

22. A leak test system as defined in claim 21, wherein said fourteenth determining means determines there is no leak in said third valve when the pressure in said first flowpath section after closing said third valve is lower than a predetermined value $-p_4$.

23. A leak test system as defined in claim 22, further comprising means for varying said predetermined value $-p_4$ according to a load on said engine.

24. A leak test system as deemed in claim 21, wherein said system further comprises a fourth timer for measuring a time elapsed from when said third valve is closed, and said fourteenth determining means determines that there is no leak in said third valve if the pressure in said first flowpath section when the time measured by said fourth timer has reached a predetermined value $t_6$, is lower than a predetermined value $-p_4$.

25. A leak test system as defined in claim 24, further comprising means for varying said predetermined value $t_6$ according to a load on said engine.

26. A leak test system as defined in claim 3, further comprising fifteenth determining means for determining whether or not the predetermined negative pressure test condition holds when there is a leak in said first flowpath section, eighth operating means for closing said second and third valves so as to seal said first flowpath section when said negative pressure test condition holds, ninth operating means for opening said second valve in the sealed state of said first flowpath section, means for sampling a pressure $P_1$ detected by said pressure detecting means after an operation of said ninth operating means, tenth operating means for opening said first valve and closing said second and third valves when said negative pressure test condition holds, eleventh operating means for opening said second valve after an operation of said tenth operating means, means for sampling a pressure $P_2$ detected by said pressure detecting means after an operation of said eleventh operating means, and sixteenth determining means for determining whether or not there is a fault in said first valve based on said pressures $P_1$ and $P_2$.

27. A leak test system as defined in claim 26, wherein said sixteenth determining means determines that there is no fault in said first valve when said pressure $P_1$ is lower than said pressure $P_2$.

28. A leak test system as defined in claim 26, wherein said sixteenth determining means comprises means for calculating a variation $\Delta P_1$ in a predetermined time interval of said pressure $P_1$, means for calculating a variation $\Delta P_2$ in a predetermined time interval of said pressure $P_2$, and seventeenth determining means for determining whether or not there is a fault in said first valve based on said pressure variations $\Delta P_1$ and $\Delta P_2$.

29. A leak test system as defined in claim 28, wherein said seventeenth determining means determines that there is no fault in said first valve when the pressure variation $\Delta P_1$ is larger than the pressure variation $\Delta P_2$.

30. A leak test system as defined in claim 3, further comprising eighteenth determining means for determining whether or not the predetermined negative pressure test condition holds when there is a leak in said first flowpath section, means for closing said second valve and opening said third valve so as to open said second flowpath section to the atmosphere when said predetermined negative pressure test condition holds, twelfth operating means for closing said first and third valves when said second flowpath section has been opened to the atmosphere, means for sampling a pressure $P_1$ detected by said pressure detecting means after an operation of said twelfth operating means, thirteenth operating means for opening said first and second valves and closing said third valve when said second flowpath section has been opened to the atmosphere, means for sampling a pressure $P_1$ detected by said pressure detecting means after an operation of said thirteenth operating means, and nineteenth determining means for determining whether or not there is a fault in said first valve based on said pressures $P_1$ and $P_2$.

31. A leak test system as defined in claim 3, further comprising twentieth determining means for determining whether or not the predetermined negative pressure test condition holds when there is a leak in said first flowpath section, thirteenth operating means for closing said second and third valves so as to seal said first flowpath section, fourteenth operating means for opening said second valve in the sealed state of said first flowpath section, a fifth timer for measuring a time elapsed after an operation of said fourteenth operating means, means for sampling a measured time $t_7$ of said fifth timer when the pressure detected by said pressure detecting means has reached a predetermined value $-p_4$, fifteenth operating means for opening said first valve and closing said second and third valves when said negative pressure test condition holds, sixteenth operating means for opening said second valve after operation of said fifteenth operating means, a sixth timer for measuring a time elapsed after an operation of said sixteenth operating means, means for sampling a pressure $P_3$ detected by said pressure detecting means when the time measured by said sixth timer has reached the time $t_7$, and twenty-first determining means for determining that there is no fault in said first valve when $|P_3-P_4|$ is equal to or greater than a predetermined value $p_5$.

* * * * *